US006653035B2

(12) United States Patent
Komoto et al.

(10) Patent No.: US 6,653,035 B2
(45) Date of Patent: Nov. 25, 2003

(54) MAGNETIC TONER

(75) Inventors: Keiji Komoto, Numazu (JP); Tatsuya Nakamura, Mishima (JP); Tatsuhiko Chiba, Kamakura (JP); Michihisa Magome, Suntoh-gun (JP); Akira Hashimoto, Suntoh-gun (JP); Takeshi Kaburagi, Susono (JP); Eriko Yanase, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/202,903

(22) Filed: Jul. 26, 2002

(65) Prior Publication Data

US 2003/0064309 A1 Apr. 3, 2003

(30) Foreign Application Priority Data

Jul. 30, 2001 (JP) ..... 2001-229674

(51) Int. Cl.[7] ..... G03G 9/083

(52) U.S. Cl. ..... 430/106.1; 430/108.5; 430/110.3; 430/111.4; 430/111.41

(58) Field of Search ..... 430/106.1, 108.5, 430/110.3, 111.4, 111.41

(56) References Cited

U.S. PATENT DOCUMENTS 5,456,990 A * 10/1995 Takagi et al. ..... 430/106.6
6,447,969 B1 * 9/2002 Ito et al. ..... 430/106.2

* cited by examiner

*Primary Examiner*—John Goodrow
(74) *Attorney, Agent, or Firm*—Fitzpatrick, Cella, Harper & Scinto

(57) ABSTRACT

A magnetic toner exhibiting stable performances under various environmental conditions is formed of toner particles each comprising at least a binder resin and iron oxide dispersed therein. Relative to the dry specific gravity (A) of the magnetic toner, the magnetic toner is characterized by a specific gravity distribution of toner particle fractions obtainable through wet sedimentation and including: at most 15 wt. % of a fraction having a specific gravity of above (A)×1.000 and at most (A)×1.025, 0.1–20 wt. % of a fraction having a specific gravity of above (A)×0.975 and at most (A)×1.000, at least 30 wt. % of a fraction having a specific gravity of above (A)×0.950 and at most (A)×0.975, 0.1–20 wt. % of a fraction having a specific gravity of above (A)×0.925 and at most (A)×0.950, and at most 15 wt. % of a fraction having a specific gravity of above (A)×0.900 and at most (A)×0.925.

28 Claims, 3 Drawing Sheets

MAGNETIC TONER

FIELD OF THE INVENTION AND RELATED ART

The present invention relates to a magnetic toner for developing electrostatic latent images in recording methods utilizing electrophotography, electrostatic recording, magnetic recording, toner jetting, etc.

Hitherto, a large number of electrophotographic processes have been known. Generally, in these prcesses, an electrostatic latent image is formed on an electrostatic image-bearing member (hereinafter also called a "photosensitive member") utilizing ordinarily a photoconductive material, the latent image is then developed with a toner to form a visible toner image, and the toner image, after being transferred as desired onto a transfer(-receiving) material such as paper, is fixed onto the transfer material by application of heat, pressure, heat and pressure, etc., to provide a product copy or print.

As a method for visualizing the electrostatic latent image with a toner, there have been used the cascade developing method, the magnetic brush developing method, the pressure developing method, the magnetic brush developing method using a two-component developer comprising a carrier and a toner, the non-contact mono-component developing method wherein a toner on a toner-carrying member is caused to jump onto a photosensitive member disposed in no contact with the toner-carrying member; the contact mono-component developing method wherein a toner on a toner-carrying member pressed against a photosensitive member is transferred to the photosensitive member under an electric field, and further the so-called jumping method wherein a magnetic toner carried on a rotatory sleeve (as a toner-carrying member) in which a magnetic role is disposed is caused to jump under an electric field from the sleeve onto the photosensitive member.

As a technical trend of an electrophotographic apparatus, such as a printer, higher resolutions of 1200 dpi and 2400 dpi are desired from a conventional level of 300 dpi or 600 dpi. Accordingly, the developing scheme is required of a higher resolution correspondingly. Also, a copying machine is required to achieve higher functions, so that a digital image forming technique is predominant. This is principally achieved by using a laser beam for forming electrostatic images, and a higher resolution is desired, thus requiring a high-resolution and high-definition developing scheme.

A magnetic developer (hereinafter simply represented as a "magnetic toner") used in the jumping method comprises fine particles containing a particulate form of magnetic material such as triiron tetroxide (magnetite) uniformly dispersed in a binder resin together with a wax for improving the fixability. Hitherto, various proposals have been made regarding toner production conditions, surface property and shape of the magnetic material, and species and viscoelasticity of the binder resin, for uniformizing the dispersion state of the magnetic material. However, even a magnetic toner containing a uniformly dispersed magnetic material as described and capable of realizing a satisfactorily high resolution is liable to exhibit insufficient performances in continuous image formation on a large number of sheets in an environment of high temperature/high humidity or low humidity. For example, in the case of continuous formation of high-areal percentage images in a high temperature/high humidity environment, the resolution is liable to be lowered to result in inferior thin line reproducibility, and in the case of continuous formation of low-areal percentage images in a low humidity environment, the resolution may be retained at a satisfactory level, but the density uniformity of a solid image is liable to be impaired. Thus, there is left a room for improvement regarding satisfaction of both the resolutions and the solid image uniformity. The use of a small-particle size and spherical toner has been known as an effective means for improving the image quality, and such a toner is disclosed in JP-A 9-62029 and EP-A 1058157. However, further improvements in environmental stability and image quality are expected.

JP-A 2002-148853 has disclosed an effect of specifying saturated magnetization of the fine powder fraction and the coarse powder fraction for improving the developing performance. However, further improvement in image quality is still desired.

SUMMARY OF THE INVENTION

A generic object of the present invention is to provide a magnetic toner having solved the above-mentioned problems of the prior art.

A more specific object of the present invention is to provide a magnetic toner exhibiting a high coloring power, capable of satisfying both thin-line reproducibility and solid image density uniformity without being affected by changes in environmental conditions and areal percentages of images and capable of maintaining high image quality for a long period.

In view of diversity of environments and conditions for use of a toner, we have made an extensive study for stabilization of image qualities even in the case of changes in environments and conditions for toner use, and as a result, it has been found possible to solve the problem by using a toner satisfying a particular specific gravity distribution characteristic whereby the present invention has been arrived at.

More specifically, according to the present invention, there is provided a magnetic toner, having a dry specific gravity of (A) and comprising toner particles each comprising at least a binder resin and iron oxide dispersed therein, wherein the magnetic toner has a specific gravity distribution of toner particle fractions obtainable through wet sedimentation and including:

- at most 15 wt. % of a fraction having a specific gravity of above (A)×1.000 and at most (A)×1.025,
- 0.1–20 wt. % of a fraction having a specific gravity of above (A)×0.975 and at most (A)×1.000,
- at least 30 wt. % of a fraction having a specific gravity of above (A)×0.950 and at most (A)×0.975,
- 0.1–20 wt. % of a fraction having a specific gravity of above (A)×0.925 and at most (A)×0.950, and
- at most 15 wt. % of a fraction having a specific gravity of above (A)×0.900 and at most (A)×0.925.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
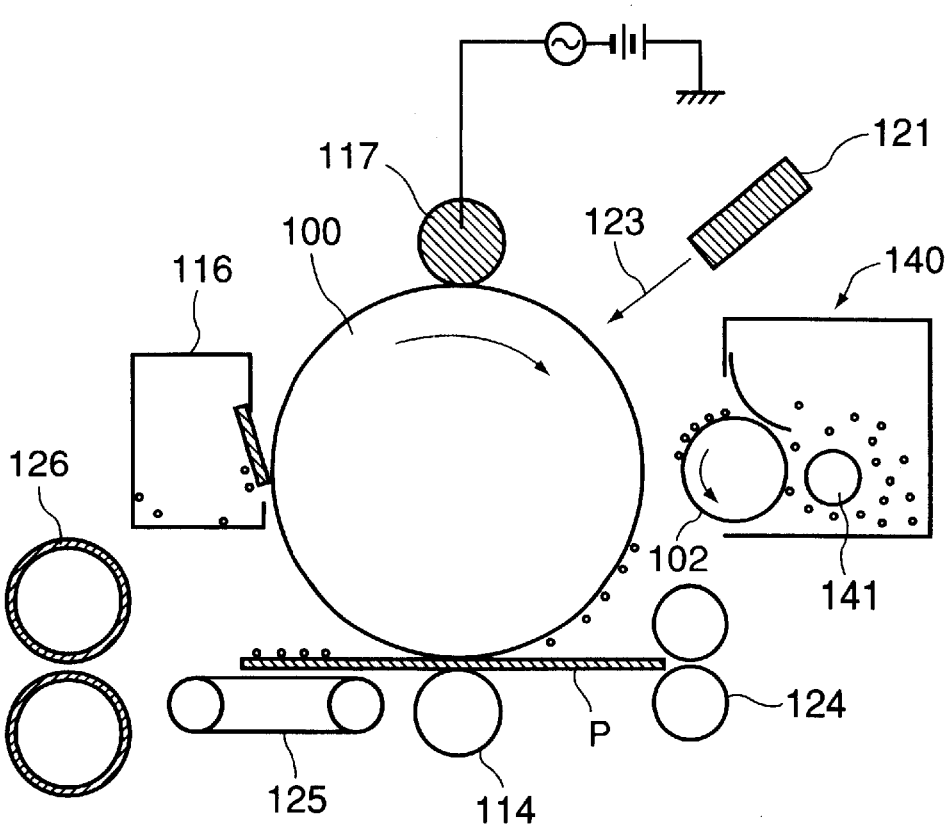
FIG. 1 is a schematic illustration of an image forming apparatus suitable for using a magnetic toner of the invention.

The magnetic toner of the present invention comprises toner particles having a specific gravity distribution of toner particle fractions obtainable through wet sedimentation and including:

- at most 15 wt. % of a fraction having a specific gravity of above (A)×1.000 and at most (A)×1.025,
- 0.1–20 wt. % of a fraction having a specific gravity of above (A)×0.975 and at most (A)×1.000,
- at least 30 wt. % of a fraction having a specific gravity of above (A)×0.950 and at most (A)×0.975,
- 0.1–20 wt. % of a fraction having a specific gravity of above (A)×0.925 and at most (A)×0.950, and
- at most 15 wt. % of a fraction having a specific gravity of above (A)×0.900 and at most (A)×0.925, whereby the magnetic toner can satisfy both good thin-line reproducibility and solid image density uniformity over a wide range of environmental conditions ranging from a high temperature/high humidity environment to a (low temperature/) low humidity environment.

It is preferred that the magnetic toner has a specific gravity distribution of toner particle fractions including:

- at most 10 wt. % of a fraction having a specific gravity of above (A)×1.000 and at most (A)×1.025,
- 0.5–15 wt. % of a fraction having a specific gravity of above (A)×0.975 and at most (A)×1.000,
- at least 40 wt. % of a fraction having a specific gravity of above (A)×0.950 and at most (A)×0.975,
- 0.5–15 wt. % of a fraction having a specific gravity of above (A)×0.925 and at most (A)×0.950, and
- at most 10 wt. % of a fraction having a specific gravity of above (A)×0.900 and at most (A)×0.925.

It is further preferred that the magnetic toner has a specific gravity distribution of toner particle fractions obtainable through wet sedimentation and including:

- 1–5 wt. % of a fraction having a specific gravity of above (A)×1.000 and at most (A)×1.025,
- 3–10 wt. % of a fraction having a specific gravity of above (A)×0.975 and at most (A)×1.000,
- 40–90 wt. % of a fraction having a specific gravity of above (A)×0.950 and at most (A)×0.975,
- 3–10 wt. % of a fraction having a specific gravity of above (A)×0.925 and at most (A)×0.950, and
- 1–5 wt. % of a fraction having a specific gravity of above (A)×0.900 and at most (A)×0.925.

The specific gravity distribution of magnetic toners characterizing the magnetic toner of the present invention described herein is based the results measured according to the following wet sedimentation method.

A dry specific gravity (A) of a sample toner (including an external additive, if any, is measured by using a dry densitometer ("ACUPIC 1330", made by Shimadzu Seisakusho K.K.).

Based on the measured value of (A), 6 aqueous solutions having 6 specified levels of specific gravities differing by an increment of 2.5% each in a range of −10% to +2.5% with respect to (A), i.e., (A)×0.900, (A)×0.925, (A)×0.950, (A)×0.975, (A)×1.000 ad (A)×1.025. Each aqueous solution is caused to contain ca. 0.01–0.1 wt. %, e.g., ca. 0.01 wt. % of a nonionic surfactant ("CONTAMINONE", made by Wako Jun'yaku K.K.). The sample toner is accurately weighed at 100 mg and dispersed in each of the 6 aqueous solutions in an amount of 50 g each, followed by ultrasonic dispersion into primary particles as confirmed by observation through an optical microscope (or a Coulter counter) and then sedimentation by standing still for 24 hours (or by centrifugation). Then, the supernatant is removed by decantation, and the faction of toner particles settled to the bottom of the liquid is washed with deionized water. The operation of decantation and washing with deionized water is repeated three times, for removing residue of a water-soluble salt used for specific gravity adjustment as described later. Then, the settled toner particles are dried and then accurately weighed.

According to the above method, a fraction of toner particles having a specific gravity higher than that of the aqueous solution concerned forms the sediment. Accordingly, in the case of using an aqueous solution having a specific gravity of (A)×0.900, for example, the sediment toner particles each have a specific gravity exceeding (A)×0.900. The weight of the sediment toner particles is denoted by W1. Similarly, in the case of using an aqueous solution having a specific gravity of (A)×0.925, the sediment toner particles each have a specific gravity exceeding (A)×0.925, while the floating or suspended toner particles each have a specific gravity of at most (A)×0.925. The weight of the sediment toner particles is denoted by W2.

The difference: W1−W2 represents a fraction of toner particles which form the sediment in the aqueous solution of (A)×0.900 and are floated or suspended in the aqueous solution of (A)×0.925, thus having a specific gravity of above (A)×0.900 and at most (A)×0.925.

In this way, according to the above-mentioned wet sedimentation method utilizing a principle that a fraction of toner particles forming the sediment in an aqueous solution having a certain specific gravity have a specific gravity higher than that of the aqueous solution, an amount of toner particle fraction falling within a specific gravity channel as a difference in weight of sediments formed in a pair of aqueous solutions having neighboring specific gravity levels. For the above sedimentation method, aqueous solutions having elevated specific gravities may be formed by using water-soluble salts, such as sodium iodide, zinc chloride, zinc bromide and tin chloride. For the present invention, it is suitable to use zinc chloride or zinc bromide.

The reason why the magnetic toner according to the present invention satisfying the above-mentioned specific gravity distribution exhibits the above-mentioned stable performances regardless of environmental condition change, is deliberated by us as follows.

Among toner particles having a specific gravity distribution as mentioned above, with reference to toner particles falling within a mode specific gravity channel occupying the largest amount of toner particles, a fraction of toner particles falling within a lower specific gravity channel contain a subtly smaller amount of magnetic material (magnetic iron oxide) and therefore have a slightly lower weight per toner particle for an identical particle size. On the other hand, toner particles of equal particle sizes have equal surface areas and accordingly are ordinarily provided with equal triboelectric charges since they are subjected to equal opportunities of triboelectrification with the sleeve (toner-carrying member) or blade. In such a case, there is a tendency that toner particles having a smaller specific gravity acquire a slightly higher triboelectric charge per unit weight and exhibit a slightly higher charging speed as a secondary effect. Further, in the case of the jumping developing scheme using a magnet roll in the sleeve, such toner particles having a lower specific gravity (containing a slightly less magnetic material) tend to receive a slightly smaller magnetic constraint force from the sleeve. Accordingly, toner particles in a lower specific gravity channel are provided with a slightly higher charge even in a high temperature/high humidity environment and exhibit a slightly quicker chargeability than toner particles in the mode specific gravity channel. Further, because of a slightly smaller magnetic constraint force, they contribute to exhibit a higher developing efficiency under an identical environmental condition. In the actual development with a toner, toner particles in the mode specific gravity channel are principally used, but if a certain proportion of lower specific gravity fraction is co-present, it becomes possible to realize a density uniformity even in the case of continuous formation of a high-areal percentage image (like a solid image) in a high temperature/high humidity environment for the above-mentioned reason. The presence of such a lower-specific gravity fraction within the specified range according to the present invention does not result in image defects, such as scattering or ghost, liable to be caused by a higher chargeability, even in a low humidity environment. This is presumably because the difference in magnetic material content between the lower specific gravity fraction and the mode specific gravity channel fraction is not so large but a moderate degree of difference leading to a moderate chargeability difference, and also the lowest specific gravity range and the amount of such low specific gravity fractions are limited.

On the other hand, it is considered that the presence of a higher-specific gravity fraction having a specific gravity slightly higher than that of the mode specific gravity channel fraction, i.e., containing a slightly larger amount of magnetic material, in a certain proportion, allows the magnetic constraint force to reach up to the tip of toner ears forming a magnetic brush on the sleeve, thus exerting a necessary magnetic constraint force even onto the lower-specific gravity fraction to obviate difficulties, such as scattering and fog, as mentioned above.

Further, such a higher-specific gravity fraction containing a slightly larger amount of magnetic material tends to have a slightly lower charge at an identical particle size than the mode specific gravity channel fraction because of a slightly larger weight and receive a slightly larger magnetic constraint force from the sleeve in the jumping developing mode. As a result, the higher-specific gravity fraction is less liable to be excessively charged in formation of low-areal percentage images in a low temperature/low humidity environment and tends to suppress the scattering such a low humidity environment because of a slightly larger magnetic constraint force. Further, such a higher-specific gravity fraction is also effective for suppressing the scattering of a lower-specific gravity fraction, thus exhibiting an effect of faithfully reproducing thin line images. The presence of such a higher-specific gravity fraction within a range specified by the present invention can obviate an insufficient charge or solid image density irregularity due to slow charging speed in a high temperature/high humidity environment.

For the reasons described above, the magnetic toner satisfying the above-mentioned specific gravity distribution can satisfy both thin-line reproducibility and solid image density uniformity without being affected by changes in environmental conditions and areal image-percentages, thus retaining high image quality for a long period.

In other words, within the specified range of specific gravity distribution, the magnetic toner of the present invention exhibits good image quality stability and can obviate image quality deterioration such as density irregularity due to difference in coloring power of individual toner particles liable to be caused by difference in amount of magnetic material in toner particles attributable to the specific gravity distribution.

However, if the amount of the lower specific gravity fraction exceeds the range of the present invention, the liability of excessive charge leading to image defects such as fog and scattering is substantially increased in a low humidity environment. On the other hand, if the amount of the higher-specific gravity fraction exceeds the range of the present invention, the liability of density irregularity in solid image is substantially increased in a high temperature/high humidity environment.

The specific gravity distribution of the magnetic toner according to the present invention may be achieved, by adjusting shape and density under pressure of iron oxide powder as magnetic material, polarity and viscoelectricity of binder resin, and melt-kneading conditions, etc., in the case of toner production through the pulverization process. On the other hand, in the case of toner production through the polymerization process, the specific gravity distribution may be achieved by adjusting shape and surface chemical composition of iron oxide powder as magnetic material, composition and polarity of polymerizable monomers, polymerization speed, etc.

The specific gravity distribution is remarkably affected by surface states of iron oxide powder as the magnetic material and mutual interaction with the other toner ingredients. More specifically, with respect to the iron oxide powder, not only the surface chemical composition but also the particle size and its distribution remarkably affect the specific gravity distribution. Further, by using iron oxide powder surface-treated with a surface-treating agent in a manner described hereinafter and having a specified particle size distribution, the above-mentioned specific gravity distribution of the magnetic toner according to the present invention may be achieved.

Further, the addition of a sulfur-containing polymer as described hereinafter is further suitable for achieving the specific gravity distribution. This is considered effective because of an appropriate degree of interaction of the sulfur element and the elements, such as iron, oxygen and silicon constituting the iron oxide.

The magnetic toner according to the present invention may preferably be produced through suspension polymerization so as to provide an appropriate level of average circularity described hereinafter. In this case, however, because of the necessity of dispersing a polymerizable monomer comprising ingredients including a polymerizable monomer and iron oxide having a substantial specific gravity difference therebetween in water under application of a shearing force, there is a possibility of non-uniform distribution of specific gravity and particle size of toner particles with respect to a weight-average particle size (D4, as measured by a Coulter counter described hereinafter) such that the lower-specific gravity fraction has a smaller weight-average particle size and the higher-specific gravity fraction has a larger weight-average particle size, respectively, compared with the weight-average particle size of the entire toner. If the non-uniform distribution becomes substantial, the image qualities are liable to change substantially depending on changes in environmental conditions. This difficulty can be substantially obviated if the following relationships are satisfied.

$$(D4L)/(D4A) \geqq 0.8 \text{ and } (D4H)/(D4A) \leqq 1.1,$$

wherein (D4L) represents a weight-average particle size of a toner particle fraction having a specific gravity of at most (A)×0.950, (D4H) represents a weight-average particle size of a toner particle fraction having a specific gravity larger than (A)×0.975, and (D4A) represents a weight-average particle size of the entire toner particles. The satisfaction of the above-mentioned relationships is considered to provide a proper relationship between the specific surface area and the chargeability of the toner particles.

For similar reasons, it further preferred satisfy:

$$(D4L)/(D4A) \geqq 0.9 \text{ and } (D4H)/(D4A) \leqq 1.05,$$

more preferably $$(D4L)/(D4A) \geqq 0.95 \text{ and } (D4H)/(D4A) \leqq 1.03,$$

Further, if the toner particle surface is substantially free from exposure of iron oxide functioning as charge leakage sites, the toner chargeability can be stabilized to allow faithful reproduction of latent images. As a result, it becomes possible to provide good images having a high resolution and a high image density.

Further, by using a magnetic toner exhibiting high average circularity and high mode circularity, the individual magnetic toner particles can acquire a uniform charge to form thin ears in the developing region, thus providing good images with very little fog and satisfying both solid image uniformity and thin-line reproducibility. Further, as the transferability is also improved, it is possible to form images faithful to latent images on a transfer material.

The organization of the magnetic toner (particles) according to the present invention will be described in further detail.

The magnetic toner particles according to the present invention contain at least magnetic iron oxide as a magnetic material. In this instance, it is preferred that the toner particles are substantially free from surface-exposed iron oxide functioning as charge leakage sites, thereby exhibiting a stable chargeability. This is satisfied by a low B/A ratio of below 0.001 between a surface-exposed content B of iron and a surface exposed content A of carbon represented by peaktops at 706–730 eV and 283–293 eV, respectively, in terms of bond energy as measured by X-ray photoelectron spectroscopy. The B/A ratio is more preferably below 0.0065, further preferably below 0.0003.

More specifically, in case where a magnetic toner containing iron oxide exposed to the toner particle surfaces is used, charge leakage is caused by the exposed iron oxide. If charged toner particles lose their charge before the development to have a remarkably lower charge, the toner particles are liable to be attached to a non-image area to result in image fog. On the other hand, if toner particles lose their charge after being transferred onto the photosensitive member, the toner particles are liable to fail in transfer onto a transfer member but remain on the photosensitive member, thus resulting in image defects, such as transfer dropout or hollow image. However, by using a magnetic toner satisfying B/A<0.001, i.e., with extremely low exposed iron oxide at the toner particle surfaces, it is possible to obtain high-quality images with low image fog and faithful to latent images.

The iron/carbon content ratio (B/A) at the toner particle surfaces described herein is based on values measured through surface composition analysis by ESCA (X-ray photoelectron spectroscopy) according to the following conditions.

Apparatus: X-ray photoelectrospectroscope Model "1606S" (made by PHI Co.)

Measurement conditions: X-ray source MgKα (400 W) Spectrum region in a diameter of 800 μm.

From the measured peak intensities of respective elements, the surface atomic concentrations are calculated based on relative sensitivity factors provided from PHI Co. For the measurement, a sample toner is washed with a solvent, such as isopropyl alcohol, under application of ultrasonic wave, to remove the external additive attached to the magnetic toner particle surfaces, and then the magnetic toner particles are recorded magnetically and dried for ESCA measurement.

A preferred dispersion state of iron oxide powder in toner particles of the present invention is such that iron oxide powder is dispersed and evenly present in the entirety of toner particles without causing agglomeration. This is another preferred feature of the magnetic toner of the present invention. More specifically, based on an observation of a toner particle section through a transmission electron microscope (TEM), at least 50% by number of toner particles are required to satisfy a relationship of $D/C \leqq 0.02$, wherein C represents a projection area-based circle-equivalent diameter of the toner particle, and D represents a minimum distance between a toner particle surface and individual iron oxide powder particles on a toner particle sectional picture taken through a TEM.

It is further preferred that at least 65% by number, more preferably at least 75% by number, of toner particles satisfy the relationship of $D/C \leqq 0.02$.

In case where less than 50% by number of toner particles satisfy the relationship of $D/C \leqq 0.02$, more than a half of toner particles contain no magnetic powder at all within a shell region outside a boundary defined by D/C=0.02. If such a toner particle is assumed to have a spherical shape, the magnetic powder-free shell region occupies at least 11.5% of the whole particle volume. Moreover, in such a particle, the magnetic powder is not actually present aligning on the boundary of D/C=0.02 so that iron oxide powder is not substantially present in a superficial portion of at least 12%. Such a magnetic toner having a magnetic powder-free shell region is liable to suffer from various difficulties as follows.

(i) The iron oxide powder is localized at the inner portion of the toner particle, so that the liability of agglomeration of the iron oxide powder is increased to result in a lower coloring power.

(ii) While the toner particles are caused to have an increased specific gravity at an increased iron oxide content, the binder resin and wax are localized at the superficial portion of the toner particles. Accordingly, even if such a surface layer is formed on toner particle surfaces, such toner particles are liable to cause melt-sticking or deformation when subjected to a stress during the toner production, so that the handing of toner particles during the toner production become complicated and the toner powdery characteristic is changed to adversely affect the electrophotographic performances and storage stability of the toner due to blocking of the toner particles.

(iii) Due to a soft superficial portion of the toner particles, the external additive particles are liable to be embedded at the toner particle surfaces, thereby deteriorating the continuous image forming performances of the toner.

The above-mentioned difficulties, such as a lower coloring power, inferior anti-blocking property and deterioration of continuous image forming performances, are liable to be enhanced when less than 50% by number of toner particles satisfy the relationship of D/C≦0.02.

For measurement of the D/C ratio by observation through a TEM, sample toner particles are sufficiently dispersed in a room temperature-curable epoxy resin, and the epoxy resin is cured for 2 days in an environment of 40° C. to form a cured product, which is then sliced, as it is or after freezing, into thin flake samples by a microtome equipped with a diamond cutter.

The D/C ratio measurement is more specifically performed as follows.

From sectional picture samples photographed through a TEM, particles having a particle size falling within a range of D1±10% (wherein D1 is a number-average particle size of toner particles measured by using a Coulter counter as described hereinbelow) are selected for determination of D/C ratios. Thus, for each particle thus selected, a minimum distance between the particle surface and magnetic powder particles contained therein (D) is measured to calculate a D/C ratio (relative to the circle-equivalent diameter C determined from a sectional area in a microscopic photograph, and calculate the percentage by number of toner particles satisfying D/C≦0.02 from the following equation (III):

Percentage (%) of toner particles satisfying $D/C \leqq 0.02$={[number of toner particles satisfying $D/C \leqq 0.02$ among the selected toner particles on pictures]/[the number of the selected toner particles (i.e., particles having a circle equivalent diameter) falling in a range of $D1 \pm 10\%$ ($D1$: number-average particle size) on the pictures]}×100 (III)

The percentage values (of D/C≦0.02) described herein are determined based on pictures at a magnification of 10,000 photographed through a transmission electron microscope ("H-600", made by Hitachi K.K.) at an acceleration voltage of 100 kV.

The number-basis and volume-basis particle size distributions and average particle sizes may be measured by using, e.g., Coulter counter Model TA-II or Coulter Multicizer (respectively available from Coulter Electronics, Inc.). Herein, these values are determined based on values measured by using Coulter Multicizer connected to an interface (made by Nikkaki K.K.) and a personal computer ("PC9801", made by NEC K.K.) for providing a number-basis distribution and a volume-basis distribution in the following manner. A 1%-aqueous solution is prepared as an electrolytic solution by using a reagent-grade sodium chloride (it is also possible to use ISOTON R-II (available from Coulter Scientific Japan K.K.)). For the measurement, 0.1 to 5 ml of a surfactant, preferably a solution of an alkylbenzenesulfonic acid salt, is added as a dispersant into 100 to 150 ml of the electrolytic solution, and 2–20 mg of a sample toner is added thereto. The resultant dispersion of the sample in the electrolytic solution is subjected to a dispersion treatment for ca. 1–3 minutes by means of an ultrasonic disperser, and then subjected to measurement of particle size distribution in the range of 2 μm or larger by using the above-mentioned Coulter counter with a 100 μm-aperture to obtain a volume-basis distribution and a number-basis distribution. From the volume-basis distribution, a weight-average particle size (D4) is calculated, and from the number-basis distribution, a number-average particle size (D1) is calculated.

The magnetic toner of the present invention may preferably have an average circularity of at least 0.970. A toner composed of particles having an average circularity of at least 0.970 exhibits very excellent transferability. This is presumably because the toner particles contact the photosensitive member at a small contact area so that the forces of attachment of toner particles onto the photosensitive member, such as an image force and a van der Waals force, are lowered. Accordingly, the improved solid image density uniformity and thin-line reproducibility attained by the specified specific gravity distribution are enhanced by such an improved transferability at a reduced toner consumption.

Further, toner particles having an average circularity (Cav) of at least 0.970 are substantially free from surface edges, so that localization of charge in individual toner particle is less liable to occur, thus tending to provide a narrower charge distribution and allowing faithful reproduction of latent images. Even at a high average circularity, however, the above-mentioned effects can be lowered if a mode circularity (i.e., a most frequency occurring circularity of toner particles) is relatively low. Accordingly, the magnetic toner particles of the present invention may further preferably exhibit a mode circularity (Cmode) of at least 0.99. A mode circularity of at least 0.99 means that a large proportion of toner particles have a shape exhibiting a circularity of at least 0.99 and close to that of a true sphere, thus enhancing the above-mentioned effects.

The average circularity and mode circularity are used as quantitative measures for evaluating particle shapes and based on values measured by using a flow-type particle image analyzer ("FPIA-1000", mfd. by Toa Iyou Denshi K.K.). A circularity (Ci) of each individual particle (having a circle equivalent diameter ($D_{CE}$) of at least 3.0 μm) is determined according to an equation (1) below, and the circularity value (Ci) are totaled and divided by the number of total particles (m) to determine an average circularity (Cav.) as shown in an equation (2) below:

$$\text{Circularity } Ci = L_0/L, \quad (1)$$

wherein L denotes a circumferential length of a particle projection image, and $L_0$ denotes a circumferential length of a circle having an area identical to that of the particle projection image.

$$\text{Average circularity } (Cav) = \sum_{i=1}^{m} Ci/m \quad (2)$$

Further, the mode circularity (Cmode) is determined by allotting the measured circularity values of individual toner particles to 61 classes in the circularity range of 0.40–1.00, i.e., from 0.400–0.410, 0.410–0.420, . . . , 0.990–1.000 (for each range, the upper limit is not included) and 1.000, and taking the circularity of a class giving a highest frequency as a mode circularity (Cmode).

Incidentally, for actual calculation of an average circularity (Cav), the measured circularity values of the individual particles were divided into 61 classes in the circularity range of 0.40–1.00, and a central value of circularity of each class was multiplied with the frequency of particles of the class to provide a product, which was then summed up to provide an average circularity. It has been confirmed that the thus-calculated average circularity (Cav) is substantially identical to an average circularity value obtained (according to Equation (II) above) as an arithmetic mean of circularity values directly measured for individual particles without the above-mentioned classification adopted for the convenience of data processing, e.g., for shortening the calculation time.

More specifically, the above-mentioned FPIA measurement is performed in the following manner. Into 10 ml of water containing ca. 0.1 mg of surfactant, ca. 5 mg of magnetic toner sample is dispersed and subjected to 5 min. of dispersion by application of ultrasonic wave (20 kHz, 50 W), to form a sample dispersion liquid containing 5,000–20,000 particles/$\mu$l. The sample dispersion liquid is subjected to the FPIA analysis for measurement of the average circularity (Cav) and mode circularity (Cmode) with respect to particles having $D_{CE} \geqq 3.0$ $\mu$m.

The average circularity (Cav) used herein is a measure of roundness, a circularity of 1.00 means that the magnetic toner particles have a shape of a perfect sphere, and a lower circularity represents a complex particle shape of the magnetic toner.

As mentioned above, the circularity measurement is performed with respect to only particles having a circle-equivalent diameter of at least 3 $\mu$m. This is because particles having a circle-equivalent diameter of below 3 $\mu$m include a substantial amount of external additives present independently from the toner particles and can obstruct an accurate estimation of circularity of toner particles.

Spherical toner particles having an average circularity of at least 0.970 may be produced through various processes, inclusive of: the above-mentioned suspension polymerization process for directly producing toner particles; a dispersion polymerization process for polymerizing a monomer in the presence of a dispersion stabilizer in a solvent which dissolves the monomer but does not dissolve the resultant resin; a method of sphering under heating toner particles produced through the pulverization process; and a method of spraying a molten mixture or a solution of toner ingredient into the air. Among the above, the spraying method easily provide spherical toner particles but the resultant toner particles are liable to have a broad particle size distribution. The dispersion polymerization process allows easy production of spherical toner particles showing a very narrow particle size distribution but is accompanied with difficulties, such as a narrow latitude for material selection and use of organic solvents requiring disposal of the waste solvent and care for inflammability, thus requiring a complicated apparatus. The sphering and smoothening of pulverized toner particles cannot easily provide toner particles having an average circularity of at least 0.970 and requires an enormous processing cost, with a possibility of a lowering in toner performances during the processing. On the other hand, the suspension polymerization process allows very easy control of circularity and particle size distribution of toner particles and is particularly preferable for the production of the magnetic toner of the present invention. By using magnetic iron oxide powder uniformly surface-treated for hydrophobization, it is possible to easily obtain toner particles enclosing the iron oxide powder, i.e., substantially free from iron oxide powder exposed to the toner particle surfaces, thereby satisfying the above-mentioned B/A and D/C ratio requirements, which are effective for suppressing the abrasion or wearing of the members contacting the toner particles, such as the photosensitive member, the fixing roller or fixing film, etc.

The magnetic toner of the present invention may preferably have a toluene-equivalent organic volatile matter content (Volatile cont.) of 10–400 ppm by weight of the toner as measured at a toner heating temperature of 150° C. by organic volatile matter analysis according to the head space method.

In the head space method or organic volatile matter analysis of a toner sample, the toner sample is sealed in a closed vessel and heated at a specific temperature for a specific period to form an equilibrium state between the sample and the gaseous phase, and a portion of the gaseous phase in the closed vessel is injected into a gas chromatograph equipped with an FID as a detector to measure the organic volatile matter content. Hitherto, for the analysis of volatile matter content in a toner, a solution of the toner has been analyzed by gas chromatography. This method however has a problem that the volatile matter peak can be masked by the solvent peak.

It has been found in the magnetic toner of the present invention that the toluene-equivalent organic volatile matter content of the toner heated at 150° C. affects the state of attachment of the external additives on the toner particles, and thus the quality of images in continuous image formation on a large number of sheets. More specifically, below 10 ppm, the organic volatile matter becomes excessively reduced to lower the attachment force between the toner particles and the external additive, thus resulting in separation of the external additive, which leads to a change in triboelectric charge to cause image quality deterioration, such as a lower thin-line reproducibility, on continuation of image formation, particularly in a low humidity environment. Above 400 ppm, in a high temperature environment, the elasticity of the toner particle surface is lowered to promote the embedding of the external additive, thus similarly resulting in toner charge change to cause image quality change such as solid image uniformity.

For the above reason, the toluene-equivalent organic volatile matter content is preferably in the range of 10–400 ppm, more preferably 20–200 ppm.

The toluene-equivalent organic volatile matter content of 10–400 ppm may be achieved by various manners. For example, in the case of a polymerization toner, the residual amount of residual monomers, benzaldehyde and residues of the polymerization initiator, may be controlled by adjustment of polymerization conditions. Further, after the polymerization, the polymerization system may be subjected to distillation for distilling off the volatile matter together with water to adjust the residual content. Further, the volatile matter content may also be adjusted by conventional methods, such as gas stream drying and vacuum drying, and also by washing of toner particles with a solvent.

More specifically, the toluene-equivalent organic volatile matter content of a toner described herein is based on values measured according to the head space method in the following manner.

A sample toner is accurately weighed at 300 mg in a head space vial (volume=22 ml), and the vial is sealed by using a crimper with a crimp cap and an accessory fluorine-resin coated septum. The vial is set on a head space sampler and analyzed under the following conditions, including data processing for obtaining a total peak area on the GC chart. In this instance, an empty vial not containing the toner sample is subjected to an identical measurement to measure blank data attributable to, e.g., organic volatile matter from the septum for subtraction from the measured data. Further, for obtaining the toluene-equivalent organic volatile matter contents, a calibration curve is prepared in advance by sealing several accurate amounts (e.g., 0.1 $\mu$l, 0.5 $\mu$l, 1.0 $\mu$l, . . . ) of toluene in vials, followed by measurement under identical conditions as follows for obtaining such a calibration curve showing a relationship of charged toluene weights versus toluene peak areas. Based on the calibration curve, the toluene-equivalent organic volatile matter content can be determined from a measured peak area of organic volatile matter in the toner sample.

<Measurement Apparatus and Conditions>

Head space sampler: HEWLETT PACKARD 7694

Oven temp.: 150° C.

Sample heating time: 60 min.

Sample loop (Ni): 1 ml

Loop temp.: 170° C.

Transfer line temp.: 190° C.

Pressurizing time: 0.50 min.

Loop fill time: 0.01 min.

Loop eq. time: 0.05 min.

Inject time: 1.00 min.

GC cycle time: 80 min.

Carrier gas: He

GC: HEWLETT PACKARD 6890 GC (Detector: FID)

Column: HP-1 (Inner Dia. 0.25 μm×30 m)

Oven: Hold at 35° C. for 20 min., Ramp at 20° C./min. to 30° C., Hold for 20 min.

INJ: 300° C.

DET: 320° C.

Split-Less, Constant-Pressure (20 psi)-Mode.

The magnetic toner of the present invention may preferably have a weight-average particle size (D4) of 3–10 μm, more preferably 4–8 μm, for providing high image quality, satisfaction of both solid image uniformity and thin-line reproducibility, and faithful reproduction of minute latent image dots. A toner having D4 below 3 μm is liable to have a lower transfer efficiency leading to an increased amount of transfer residual toner on the photosensitive member, thus making it difficult to suppress the abrasion of the photosensitive member and toner sticking in the contact charging step. Further as the total area of the toner is increased, the flowability and stirability of the toner is lowered, so that the uniform charging of the individual toner particles becomes difficult to result in inferior fog and transferability and cause image irregularity in addition to the abrasion and the melt-sticking. On the other hand, at D4>10 μm, a toner is liable to result in scattering in character or line images and fail in providing high resolution. Further, for a high-resolution apparatus, a toner having D4>8 μm is liable to exhibit an inferior dot-reproducibility.

As a preferred embodiment of the magnetic toner of the present invention, by using a sulfur-containing resin, it becomes possible to provide an effective combination of the specific gravity distribution and the iron oxide dispersion state. By including a sulfur-containing resin having a high polarity, the resultant toner particles are provided with an increased charge transfer speed at the time of triboelectrification and can suppress the excessive charge in a low humidity environment and the lowering in chargeability in a high-humidity environment. However, these effects cannot be expected at a satisfactory level if not combined with conditions that the sulfur-containing resin is rich at the toner particle surfaces and the entire toner particle surfaces uniformly contact the triboelectrification member. For example, indefinitely shaped toner particles, even if they contain such a sulfur-containing resin, cannot exhibit a substantial increase in charge-transfer speed, since only projecting parts thereof contact the triboelectrification member. Further, in a dispersion state where the sulfur-containing resin is contained only inside the toner particles, a substantial improvement in chargeability cannot be expected due to insufficient contact with the triboelectrification member.

In a preferred embodiment, the sulfur-containing resin assumes a form of sulfonic acid group-containing resin.

The sulfur-containing resin may be obtained as a homopolymer or a copolymer of a sulfur-containing monomer, preferably a sulfonic acid group-containing monomer, examples of which may include: styrene-sulfonic acid, 2-acrylamido-2-methylpropanesulfonic acid, 2-methacrylamido-2-methylpropanesulfonic acid, vinylsulfonic acid, methacrylsulfonic acid, and maleic acid derivative, maleimide derivative and styrene derivative represented by structural formulae shown below. Among these, sulfonic acid group-containing (meth)acrylamide is preferred.

maleic acid amide derivative

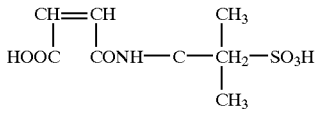

maleimide derivative

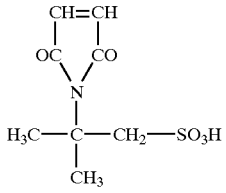

styrene derivative

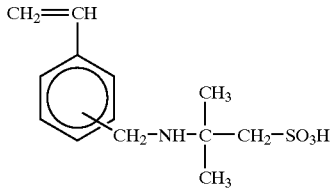

It is possible to use a homopolymer of the above-mentioned sulfur-containing monomer, or a copolymer with other polymerizable monomers, such as vinyl monomers, which may be mono-functional or polyfunctional.

More specifically, examples of monofunctional monomer for providing the sulfur-containing copolymer may include: styrene; styrene derivatives, such as α-methylstyrene, β-methylstyrene, o-methylstyrene, m-methylstyrene, p-methylstyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylic monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate; methacrylate monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl-methacrylate, diethylphosphateethyl methacrylate, and dibutylphosphateethyl methacrylate;

methyl-monocarboxylic acid esters; vinyl esters, such as vinyl acetate, vinyl propionate, vinyl lactate, vinylbenzoate, and vinyl formate; vinyl ethers, such as vinyl methyl ether, vinyl ethyl ether, and vinyl isobutyl ether; and vinyl ketones, such as vinyl methyl ketone, vinyl hexyl ketone and vinyl isopropyl ketone.

Examples of poly-functional monomer may include: diethylene glycol diacrylate, triethylene glycol diacrylate, tetraethylene glycol diacrylate, polyethylene glycol diacrylate, 1,6-hexanediole diacrylate, neopentyl glycol diacrylate, tripropylene glycol diacrylate, polypropylene glycol diacrylate, 2,2'-bis(4-(acryloxy-diethoxy)phenyl) propane, trimethylolpropane triacrylate, tetramethylmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-methacryloxydiethoxy)-phenyl)propane, 2,2'-dis(4-methacryloxy polyethoxy)-phenyl)propane, trimethylpropane trimethacrylate, tetramethylmethane tetramethacrylate, divinylbenzene, divinylnaphthalene and divinyl ether.

The sulfur-containing resin may preferably include polymerized nits of a styrene derivative.

For providing the sulfur-containing resin, bulk polymerization, solution polymerization, suspension polymerization or ionic polymerization may be used, but solution polymerization is preferred in view of the processability.

The sulfur-containing resin may have a structure represented by the following formula $$X(SO_3^-)_n \cdot mY^{k+},$$

wherein X represents polymer sites originated from the above-mentioned monomers, $Y^+$ denotes a counter ion, k denotes a valence of the counter ion, m and n are integers representing the number of the counter ion and the sulfonic acid group in the polymer and satisfying n=k×m. Preferred examples of the counter ion may include: hydrogen, sodium, potassium, calcium and ammonium, and a hydrogen ion is particularly preferred.

The sulfur-containing polymer may preferably contain polymerized units of the sulfur-containing monomer in a proportion of 0.01–20 wt. % thereof, more preferably 0.05–10 wt. %, further preferably 0.1 to 7 wt. %. Below 0.01 wt. %, the effect of addition of the sulfur-containing polymer cannot be sufficiently attained, and in excess of 20 wt. %, the dispersion stabilizer element is liable to remain in excess, to result in inferior fixability.

The sulfur-containing resin may preferably have an acid value of 3–50 mgKOH/g. If the acid value is below 3 mgKOH/g, the good iron oxide dispersion state and the charge-controlling function intended by the present invention cannot be satisfied in combination, and the environmental stability of the resultant toner can be lowered. In excess of 50 mgKOH/g, the resultant toner particles are liable to have distorted shapes showing a lower circularity, and a lower transferability, and the release agent is exposed at the surface, thus showing a lower developing performance, especially when they are formed through suspension polymerization.

The sulfur-containing resin may preferably be contained in 0.05–20 wt. parts, more preferably 0.2–10 wt. parts, per 100 wt. parts of the other binder resin. If the content is below 0.01 wt. part, the good iron oxide dispersion state and the charge controlling function obtained thereby are scarce, and in excess of 20 wt. parts, the resultant toner particles are liable to have a broad particle size distribution leading to increased fog and cause a lowering in transferability.

The sulfur-containing polymer may preferably have a weight-average molecular weight (Mw) of $2\times10^3$–$1\times10^5$. If Mw is below $2\times10^3$, the resultant toner is liable to have an inferior anti-blocking property, and in excess of $1\times10^5$, the solubility thereof in the polymerizable monomer at the time of toner production through the polymerization process is lowered and the dispersibility of the pigment is lowered to result in a toner having a lower coloring power. JP-A 11-288129 has reported that an Mw range of 2000–15,000 results in insufficient dispersion of colorant, but this is not necessarily true with respect to the dispersion of iron oxide powder in the magnetic toner of the present invention.

It is further preferred that the sulfur-containing resin has a glass transition temperature (Tg) of 50 to 100° C. as measured by differential scanning calorimetry (DSC). If Tg is below 50° C., the resultant toner is liable to have lower flowability and storage stability, and also a lower transferability. If Tg is above 100° C., the resultant toner is liable to exhibit a lower fixability, especially in the case of a high image area percentage.

The molecular weight values described herein are polystyrene-equivalent molecular weights determined from molecular weight distributions measured according to gel permeation chromatography by using a high-speed GPC apparatus ("HLC8120 GPC", made by Toso K.K.) in the following manner.

A GPC sample solution is prepared by dissolving a toner sample in tetrahydrofuran (THF) at room temperature so as to provide a resin concentration of 0.4–0.6 mg/ml, followed by filtration through a solvent-resistant membrane filter having a pore diameter of 0.2 μm.

In the GPC apparatus, a column is stabilized in a heat chamber at 40° C., tetrahydrofuran (THF) solvent is caused to flow through the column at that temperature at a rate of 1 ml/min., and ca. 100 μl of a sample solution in THF is injected. The identification of sample molecular weight and its distribution is performed based on a calibration curve obtained by using several monodisperse polystyrene samples and having a logarithmic scale of molecular weight versus count number. The standard polystyrene samples used for preparing a calibration curve were TSK Standard Polystyrene F-850, F-450, F-288, F-128, F-80, F-40, F-20, F-10, F-4, F-2, F-1, A-5000, A-2500, A-1000 and A-500 (available from Toso K.K.). An RI (refractive index)-detector and a UV (ultraviolet)-detector were used in series as a detector. It is appropriate to constitute the column as a combination of several commercially available polystyrene gel columns. For example, there was used a combination of Shodex GPC KF-801, 802, 803, 804, 805, 806, 807 and 808P available from Showa Denko K.K.

A sulfur content in the magnetic toner of the present invention may be determined according known analysis methods. For example, according to the above-mentioned X-ray photoelectron spectroscopy, it is possible to specify an appropriate content range of sulfur present at the toner particle surfaces. More specifically, it is preferred to satisfy a ratio E/A in a range of 0.0003–0.0050 between a surface-exposed content E of sulfur and the surface-exposed content A of carbon represented by peaks at 167–172 eV and at 283–293 eV, respectively, as measured by the X-ray photoelectron spectroscopy. This condition may be satisfied by controlling the average particle size of the used iron oxide powder and the amount of the sulfur-containing resin in the binder resin. If the ratio E/A is below 0.0003, it becomes difficult to attain a sufficient charge-controlling function. Above 0.0050, it becomes difficult to attain an environmental stability of chargeability.

It is preferred that the iron oxide particles (magnetic material) used in the magnetic toner of the present invention have a volume-average particle size of 0.1–0.3 μm and contain at most 40% by number of particles of 0.03–0.1 μm, based on measurement of particles having particle sizes of at least 0.03 μm.

Iron oxide particles having an average particle size of below 0.1 μm are not generally preferred because they are liable to provide a magnetic toner giving images which are somewhat tinted in red and insufficient in blackness with enhanced reddish tint in halftone images. Further, as the iron oxide particles are caused to have an increased surface area, the dispersibility thereof is lowered, and an inefficiently larger energy is consumed for the production. Further, the coloring power of the iron oxide particles can be lowered to result in insufficient image density in some cases.

On the other hand, if the iron oxide particles have an average particle size in excess of 0.3 μm, the weight per one particle is increased to increase the probability of exposure thereof to the toner particle surface due to a specific gravity difference with the binder during the production. Further, the wearing of the production apparatus can be promoted and the dispersion thereof is liable to become unstable.

Further, if particles of 0.1 μm or smaller exceed 40% by number of total particles (having particle sizes of 0.03 μm or larger), the iron oxide particles are liable to have a lower dispersibility because of an increased surface area, liable to form agglomerates in the toner to impair the toner chargeability, and are liable to have a difficulty in attaining a good balance between the solid image uniformity and thin-line reproducibility. If the percentage is lowered to at most 30% by number, the difficulties are preferably alleviated.

Incidentally, iron oxide particles having particle sizes of below 0.03 μm receive little stress during the toner production so that the probability of exposure thereof to the toner particle surface is low. Further, even if such minute particles are exposed to the toner particle surface, they do not substantially function as leakage sites lowering the chargeability of the toner particles. Accordingly, the particles of 0.03–0.1 μm are noted herein, and the percentage by number thereof is specified.

On the other hand, if particles of 0.3 μm or larger exceed 10% by number, the iron oxide particles are caused to have a lower coloring power, thus being liable to result in a lower image density. It is further preferred that the percentage be suppressed to at most 5% by number.

In the present invention, it is preferred that the iron oxide production conditions are adjusted so as to satisfy the above-mentioned conditions for the particle size distribution, or the produced iron oxide particles are used for the toner production after adjusting the particle size distribution as by pulverization and/or classification. The classification may suitably be performed by utilizing sedimentation as by a centrifuge or a thickener, or wet classification using, e.g., a cyclone.

The volume-average particle size and particle size distribution of iron oxide particles described herein are based on values measured in the following manner.

Sample iron oxide particles or toner particles containing such dispersed iron oxide particles are sufficiently dispersed in a cold-setting epoxy resin, which is then hardened for 2 days at 40° C. The hardened product is sliced into thin flakes by a microtome. The thin flakes are observed through a TEM and photographic at magnification of $1\times10^4$–$4\times10^4$. One hundred iron oxide particles of at least 0.03 μm in particle size selected at random in visual fields of the taken photographs are subjected to measurement of projection areas. From the projection areas of the 100 iron oxide particles, a volume-average particle size (projection area-equivalent circular diameter), percentage by number of particles of 0.03 μm–0.1 μm and percentage by number of particles of 0.3 μm or larger are determined similarly as the above.

The magnetic material used in the present invention principally comprise an iron oxide, such as triiron tetroxide (magnetite) or gamma-iron oxide, capable of further containing another element, such as cobalt, nickel, copper, magnesium, manganese or aluminum.

The toner particles constituting the magnetic toner of the present invention may preferably be produced through the polymerization process. The toner particles can also be produced through the pulverization process, but such toner particles produced through the pulverization process generally have indefinite shapes and have to be subjected to a mechanical, thermal or another special treatment for providing spherical toner particles preferably having an average circularity of at least 0.970 and a mode circularity of at least 0.990. Further, the pulverization process essentially results in toner particles in which the magnetic iron oxide particles are exposed to the toner particle surfaces, and therefore also requires a surface-modifying treatment for providing a preferable form of toner particles which are substantially free from surface-exposed iron oxide particles.

For solving the above-mentioned problems, toner particles constituting the magnetic toner of the present invention are preferably formed through the polymerization process. Toner-producing polymerization processes may include: direct polymerization, suspension polymerization, emulsion polymerization, emulsion-association polymerization and seed polymerization, at among these, suspension polymerization is particularly preferred for easiness of having a good balance between particle size and particle shape. In the suspension polymerization process, a polymerizable monomer and a magnetic iron oxide as the colorant (and optionally a polymerization initiator, a crosslinking agent, a charge control agent and other additive) may be uniformly dissolved or dispersed with each other to form a polymerizable monomer composition, which is then dispersed in a continuous dispersion medium, such as an aqueous phase, containing a dispersion stabilizer under the action of an appropriate stirring means, and simultaneously subjected to polymerization to form toner particles. The toner thus produced through suspension polymerization (hereinafter called a "polymerization toner") includes individual toner particle which be may uniformly spherical, thus easily satisfying an average circularity of at least 0.970 and a mode circularity of at least 0.990. Such a polymerization toner also has a relatively uniform charge distribution, thus showing a high transferability.

Further, fine particles obtained through suspension polymerization can be provided as desired with a core-shell structure by addition of a polymerizable monomer and a polymerization initiator for further polymerization for providing a surface layer.

However, if an ordinary iron oxide is incorporated as a magnetic material in such a polymerization toner, it is difficult to suppress the exposure of iron oxide particles to the toner particle surfaces. Further, because of a strong interaction between the iron oxide and water during polymerization toner production, it is difficult to obtain toner particles having an average circularity of 0.970 or higher.

This is presumably because (1) iron oxide particles are generally hydrophilic so that they are liable to be present at surfaces of toner particles or precursor droplets, and (2) random movement of the iron oxide particles during stirring of the aqueous medium and the suspended precursor droplet surfaces are pulled by the iron oxide particles to distort the spherical shape. For solving these problems, it is important to modify the surface property of the magnetic iron oxide particles.

For the above purpose, it is particularly preferred for the iron oxide particles constituting the magnetic toner of the present invention to have been surface-hydrophobized under such a condition that they are dispersed into primary particles in an aqueous medium and surface-treated with a coupling agent while hydrolyzing the coupling agent. This hydrophobization method is less liable to cause coalescence or agglomeration of iron oxide particles than a conventional gaseous phase hydrophobization treatment and allows a hydrophobization surface-treatment of iron oxide particles in a substantially primary particle form due to electrical repulsion between hydrophobized iron oxide particles.

The surface treatment of iron oxide particles with a hydrolyzing coupling agent in an aqueous medium does not necessitate the use of a gassifying coupling agent, such as chlorosilanes or silazanes but allows the use of a high-viscosity coupling agent which has been difficult to use because of liability of causing agglomeration of iron oxide particles when used in the conventional gaseous phase treatment, thus exhibiting a very remarkable hydrophobization effect.

As a coupling agent usable for surface-treating the magnetic iron oxide powder used in the present invention, a silane coupling agent or a titanate coupling agent may be used. A silicone coupling agent is preferred, and examples thereof may be represented by the following formula (I):

$$R_mSiY_n \quad \text{(I)},$$

wherein R denotes an alkoxy group, Y denotes a hydrocarbon group, such as alkyl, vinyl, glycidoxy or methacryl, and m and n are respectively integers of 1–3 satisfying m+n=4.

Specific examples of the silane coupling agents represented by the formula (I) may include: vinyltrimethoxysilane, vinyltriethoxysilane, gamma-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

It is particularly preferred to use an alkyltrialkoxysilane coupling agent represented by the following formula (II) to treat the magnetic powder for hydrophobization in an aqueous medium:

$$C_pH_{2p+1}—Si—(OC_qH_{2q+1})_3 \quad \text{(II)},$$

wherein p is an integer of 2–20 and q is an integer of 1–3.

In the above formula (II), if p is smaller than 2, the hydrophobization treatment may become easier, but it is difficult to impart a sufficient hydrophobicity, thus making it difficult to suppress the exposure of the magnetic powder to the toner particle surfaces. On the other hand, if p is larger than 20, the hydrophobization effect is sufficient, but the coalescence of the magnetic powder particles becomes frequent, so that it becomes difficult to sufficiently disperse the treated magnetic powder particles in the toner, thus being liable to result in a toner exhibiting lower fog-prevention effect and transferability.

If q is larger than 3, the reactivity of the silane coupling agent is lowered, so that it becomes difficult to effect sufficient hydrophobization.

In the above formula (II), it is particularly preferred that p is an integer of 3–15, and q is an integer of 1 or 2.

The coupling agent may preferably be used in 0.05–20 wt. parts, more preferably 0.1–10 wt. parts, per 100 wt. parts of the magnetic powder.

Herein, the term "aqueous medium" means a medium principally comprising water. More specifically, the aqueous medium includes water alone, and water containing a small amount of surfactant, a pH adjusting agent or/and an organic solvent.

As the surfactant, it is preferred to use a nonionic surfactant, such as polyvinyl alcohol. The surfactant may preferably be added in 0.1–5 wt. parts per 100 wt. parts of water. The pH adjusting agent may include an inorganic acid, such as hydrochloric acid. The organic solvent may include methanol which may preferably be added in a proportion of 0–500 wt. % of water.

It is preferred to effect the stirring by means of a mixer having stirring blades, e.g., a high-shearing force mixer (such as an attritor or a TK homomixer) so as to disperse the magnetic powder particles into primary particles in the aqueous medium under sufficient stirring.

The thus-surface treated magnetic powder is free from particle agglomerates and individual particles are uniformly surface-hydrophobized. Accordingly, the magnetic powder is uniformly dispersed in polymerization toner particles to provide almost spherical polymerization toner particles free from surface-exposure of the magnetic powder, especially when used in combination with the sulfur-containing resin, due to the synergistic effect therewith. Accordingly, by using such a uniformly hydrophobized magnetic iron oxide powder, it becomes possible to obtain a magnetic toner having an average circularity of at least 0.970, a mode circularity of at least 0.990 and a ratio B/A of below 0.001 between iron content B and the carbon content A at the toner particle surfaces as measured by the X-ray photoelectron spectroscopy.

The iron oxide as the magnetic material may preferably have magnetic properties inclusive of a saturation magnetization of 10–200 $Am^2/kg$ at a magnetic field of 795.8 kA/m, a residual magnetization of 1–100 $Am^2/kg$ and a coercive force of 1–30 kA/m, as measured at 25° C. by using an oscillation-type magnetometer ("VSM P-1-10", made by Toei Kogyo K.K.). The magnetic material may preferably be used in an amount of 20–200 wt. parts per 100 wt. part of the binder resin. It is particularly preferred to use such a magnetic material principally comprising magnetite.

The magnetic toner of the present invention may preferably have a magnetization ($\sigma_{79.6}$) as measured at an external magnetic field of 79.6 kA/m (1000 oersted) of 10–50 $Am^2/kg$ (emu/g) at 25° C. by using an oscillation-type magnetometer ("VSM P-1-10", made by Toei Kogyo K.K.).

The magnetic field of 79.6 kA/m is used herein as a representative value in a magnetic fields of several tens to a hundred and several tens kA/m applied to a magnetic field in many commercially available image forming apparatus.

The magnetic toner is held within a developing device without causing toner leakage by disposing a magnetic force generating means in the developing device. The conveyance and stirring of the magnetic toner is also effected under a magnetic force. By disposing a magnetic force generating means that the magnetic force acting on the toner-carrying member, the recover of transfer residual toner is further promoted and toner scattering is prevented by forming ears of magnetic toner on the toner-carrying member.

If the toner has a magnetization of below 10 $Am^2/kg$ at a magnetic field of 79.6 kA/m, it becomes difficult to convey the toner on the toner-carrying member, and toner ear formation on the toner-carrying member becomes unstable, thus failing to provide uniform charge to the toner. As a result, image defects, such as fog, image density irregularity and recovery failure of transfer-residual toner are liable to be caused. If the magnetization exceeds 50 $Am^2/kg$, the toner particles are liable to have an increased magnetic agglomeratability, to result in remarkably lower flowability and transferability. As a result, the transfer-residual toner is increased to be liable to result in lower image quality. Further, the increase in amount of magnetic material required for providing the magnetization is liable to result in an inferior fixability. If the magnetic material has an average circularity of at least 0.970 and a mode circularity of at least 0.990, the toner ears on the toner-carrying member become fine and dense, so that the toner chargeability is further uniformized to remarkably reduce the fog.

Magnetite suitably used as an iron oxide (magnetic material) used in the present invention may for example be produced through a process as described below.

To a ferrous salt aqueous solution, an alkali, such as sodium hydroxide, in an amount equivalent to the iron in the ferrous salt or larger is added optionally together with a water-soluble phosphorus compound (e.g., phosphates inclusive of ortho-phosphates, metaphosphates and phosphates, such a sodium hexametaphosphate, ammonium primary phosphate) in an amount 0.05–5.0 wt. % of phosphorus based on iron, and further optionally together with a water-soluble silicon compound (e.g., water glass, sodium silicate, potassium silicate) in an amount of 0–5.0 wt. % of silicon based on iron, to prepare an aqueous solution containing ferrous hydroxide. While retaining the pH of the thus-prepared aqueous solution at pH of at least 7, preferably pH 7–10 and warming the aqueous solution at a temperature of 70° C. or higher, air is blown into the aqueous solution to oxidize the ferrous hydroxide, thereby forming magnetic iron oxide particles.

At a final stage of the oxidation, the liquid pH is adjusted, and the slurry liquid is sufficiently stirred so as to disperse the magnetic iron oxide in primary particles. In this state, a coupling agent for hydrophobization is added to the liquid to be sufficiently mixed under stirring. Thereafter, the slurry is filtered out and dried, and the dried product is lightly disintegrated to provide hydrophobic treated magnetic iron oxide particles. Alternatively, the iron oxide particles after the oxidation reaction may be washed, filtered out and then, without being dried, re-dispersed in another aqueous medium. Then, the pH of the re-dispersion liquid is adjusted and subjected to hydrophobization by adding a coupling agent under sufficient stirring.

As the ferrous salt used in the above-mentioned production process, it is generally possible to use ferrous sulfate by-produced in the sulfuric acid process for titanium production or ferrous sulfate by-produced during surface washing of steel sheets. It is also possible to use ferrous chloride.

In the above-mentioned process for producing magnetic iron oxide from a ferrous salt aqueous solution, a ferrous salt concentration of 0.5–2 mol/liter is generally used so as to obviate an excessive viscosity increase accompanying the reaction and in view of the solubility of a ferrous salt, particularly of ferrous sulfate. A lower ferrous salt concentration generally tends to provide finer magnetic iron oxide particles. Further, as for the reaction conditions, a higher rate of air supply, and a lower reaction temperature, tend to provide finer product particles.

By using the thus-produced hydrophobic magnetic iron oxide particles for toner production, it becomes possible to obtain the toner exhibiting excellent image forming performances and stability according to the present invention.

The toner of the present invention can also contain another colorant in addition to the magnetic iron oxide. Examples of such another colorant may include: magnetic or non-magnetic inorganic compounds and known dyes and pigments. Specific examples thereof may include: particles of ferromagnetic metals, such as cobalt and nickel, alloys of these metals with chromium, manganese, copper, zinc, aluminum and rare earth elements, hematite, titanium black, nigrosine dye/pigment, carbon black and phthalocyanine. Such another colorant can also be surface-treated.

In a preferred embodiment, the toner according to the present invention may contain 0.5–40 wt. % of a release agent, such as waxes as described below.

Ordinarily, a toner image formed on a photosensitive member is transferred onto a transfer-receiving material in a transfer step, and the toner image is then fixed onto the transfer-receiving material under application of an energy, such as heat, pressure, etc., to provide a semipermanent image. For the fixation, a hot roller fixation scheme is frequently used. As mentioned above, a toner having a weight-average particle size of at most 10 $\mu$m can provide a very high definition image, but such fine toner particles when transferred onto paper as a transfer-receiving material are liable to enter gaps between paper fibers, thus receiving insufficient heat energy from the heat-fixation roller to cause low-temperature offset. By incorporating an appropriate amount of wax as a release agent in the toner of the present invention, it becomes possible to effectively prevent the abrasion of the photosensitive member while satisfying high resolution and anti-offset property in combination.

Examples of the wax usable in the toner according to the present invention may include: petroleum waxes, such as paraffin wax, microcrystalline wax and petrolatum, and derivatives thereof; montan wax and derivatives thereof, hydrocarbon wax obtained through Fischer-Tropsche process and derivatives thereof, polyolefin waxes as represented by polyethylene wax and derivatives thereof, and natural waxes such as carnauba wax and candellila wax and derivatives thereof. The derivatives herein may include: oxides, block copolymers and graft-modified products with vinyl monomers. It is also possible to use higher aliphatic alcohols, aliphatic acids such as stearic acid and palmitic acid and derivatives thereof, acid amide wax, ester wax, ketone, hardened castor oil and derivatives thereof, negative waxes and animal waxes. Among these waxes, those providing a DSC curve on temperature increase (as measured by using a differential scanning calorimeter) showing a maximum heat-absorption peak in a range of 40–110° C., particularly 45–90° C., are preferred.

The wax component may preferably be contained in 0.5–40 wt. % of the binder resin. Below 0.5 wt. %, the low-temperature offset suppression effect is scarce. Above 40 wt. %, the long-term storability of the toner is lowered, and the dispersibility of other toner ingredients is lowered to result in inferior toner flowability and lower image forming performances.

The DSC measurement for determining the maximum heat-absorption peak temperature of a wax component may be performed according to ASTM D3418-8 by using, e.g., "DSC-7" available from Perkin-Elmer Corp. Temperature compensation of the detector unit may be performed based on melting points of indium and zinc, and caloric calibration may be made based on the fusion heat of indium. For measurement, a sample is placed on an aluminum pan and heated at a rate of 10° C./min. together with a blank pan as a control.

The glass transition temperature (Tg) of a resin component, such as a binder resin and a sulfur-containing resin may also be determined through the DSC measurement. More specifically, based on a DSC curved on a second heating, a medium line is dawn at equal distances from a base line before the heat-absorption peak and a base line after the heat-absorption peak so as to provide an intersection with the heating curve before the heat-absorption peak, and a temperature at the intersection is taken as the glass transition temperature (Tg).

Next, a process for producing the magnetic toner according to the present invention through suspension polymerization, will be described.

Examples of polymerizable monomers constituting a polymerizable monomer mixture may include: styrene monomers, such as styrene, o-methylstyrene, m-methylstyrene, p-methylstyrene, p-methoxystyrene and p-ethylstyrene; acrylate esters, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylate esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile and acrylamide. These monomers may be used singly or in mixture. Among these, styrene or a styrene derivative may preferably be used singly or in mixture with another monomer so as to provide a toner with good developing performances and continuous image forming performances.

In preparation of the toner of the present invention by polymerization, it is possible to incorporate a resin in the monomer mixture. For example, in order to introduce a polymer having a hydrophilic functional group, such as amino, carboxyl, hydroxyl, sulfonic acid, glicidyl or nitrile, of which the monomer is unsuitable to be used in an aqueous suspension system because of its water-solubility resulting in emulsion polymerization, such a polymer unit may be incorporated in the monomer mixture in the form of a copolymer (random, block or graft-copolymer) of the monomer with another vinyl monomer, such as styrene or ethylene; or a polycondensate, such as polyester or polyamide; or polyaddition-type polymer, such as polyether or polyimine. If a polymer having such a polar functional group is included in the monomer mixture to be incorporated in the product toner particles, the phase separation of the wax is promoted to enhance the encapsulation of the wax, thus providing a toner with better anti-offset property, anti-blocking property, and low-temperature fixability.

For the purpose of improving the dispersibility of toner ingredients, the fixability and image forming performances of the toner, it is possible to include a resin other the above-mentioned polar resin in the monomer mixture. Examples of such a resin may include: homopolymers of styrene and its substitution derivatives, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resin, and aromatic petroleum resin. These resins may be used singly or in mixture of two or more species.

Such an additional resin may preferably be added in 1–20 wt. parts per 100 wt. parts of the monomer. Below 1 wt. part, the addition effect thereof is scarce, and above 20 wt. parts, the designing of various properties of the resultant polymerization toner becomes difficult.

Further, if a polymer having a molecular weight which is different from that of the polymer obtained by the polymerization is dissolved in the monomer for polymerization, it is possible to obtain a toner having a broad molecular weight distribution and thus showing a high anti-offset property.

For the preparation of a polymerization toner, a polymerization initiator exhibiting a halflife of 0.5–30 hours at the polymerization temperature may be added in an amount of 0.5–20 wt. parts per 100 wt. parts of the polymerizable monomer so as to obtain a polymer exhibiting a maximum in a molecular weight range of $1\times10^4$–$1\times10^5$, thereby providing the toner with a desirable strength and appropriate melt-characteristics. Examples of the polymerization initiator may include: azo- or diazo-type polymerization initiators, such as 2,2'-azobis-(2,4-dimethylvaleronitrile), 2,2'-azobisisobutyronitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

The polymerizable monomer mixture can further contain a crosslinking agent in a proportion of preferably 0.001–15 wt. % of the polymerizable monomer.

In the polymerization toner production, it is also possible to use a molecular weight-adjusting agent, examples of which may include: mercaptans, such as t-dodecylmercaptan, n-dodecylmercaptan, and n-octylmercaptan; halogenated hydrocarbons, such as carbon tetrachloride and carbon tetrabromide; and α-methylstyrene dimens. Such a molecular weight-adjusting agent may be added prior to the polymerization or in the course of polymerization, and may be added in a proportion of 0.01–10 wt. parts, preferably 0.1–5 wt. parts, per 100 wt. parts of the polymerizable monomer.

In the toner production by suspension polymerization, a polymerizable monomer mixture is formed by mixing the polymerizable monomer and the iron oxide with other toner ingredients, as desired, such as a colorant, a release agent, a plasticizer, another polymer and a crosslinking agent, and further adding thereto other additives, such as an organic solvent for lowering the viscosity of the polymer produced in the polymerization, a dispersing agent, etc. The thus-obtained polymerizable monomer mixture is further subjected to uniform dissolution or dispersion by a dispersing means, such as a homogenizer, a ball mill, a colloid mill or an ultrasonic disperser, and then charged into and suspended in an aqueous medium containing a dispersion stabilizer. In this instance, if the suspension system is subjected to dispersion into a desired toner size without a break by using a high-speed dispersing machine, such as a high-speed stirrer or an ultrasonic disperser, the resultant toner particles are provided with a sharper particle size distribution. The polymerization initiator may be added to the polymerizable monomer together with other ingredients as described above or immediately before suspension into the aqueous medium. Alternatively, it is also possible to add the polymerization initiator as a solution thereof in the polymerizable monomer or a solvent to the suspension system immediately before the initiation of the polymerization.

After the particle or droplet formation by suspension in the above-described manner using a high-speed dispersion means, the system is stirred by an ordinary stirring device so as to retain the dispersed particle state and prevent the floating or sedimentation of the particles.

In the suspension polymerization process, a known surfactant, or organic or inorganic dispersant, may be used as the dispersion stabilizer. Among these, an inorganic dispersant may preferably be used because it is less liable to result in deleterious ultrafine powder, the resultant dispersion stability is less liable to be broken even at a reaction temperature change because the dispersion stabilization effect is attained by its stearic hindrance, and it is easily washed to be free from leaving adverse effect to the toner. Examples of the inorganic dispersant may include: polyvalent metal phosphates, such as calcium phosphate, magnesium phosphate, aluminum phosphate and zinc phosphate; carbonates, such as calcium carbonate and magnesium carbonate; inorganic salts, such as calcium metasilicate, calcium sulfate and barium sulfate; and inorganic oxides, such as calcium hydroxide, magnesium hydroxide, aluminum hydroxide, silica, bentonite and alumina.

These inorganic dispersant may be used singly or in combination of two or more species in 0.2–20 wt. parts per 100 wt. parts of the polymerizable monomer. In order to obtain toner particles having a further small average size of, e.g., at most 5 $\mu$m, it is also possible to use 0.001–0.1 wt. part of a surfactant in combination. Examples of the surfactant may include: sodium dodecylbenzene sulfate, sodium tetradecyl sulfate, sodium pentadecyl sulfate, sodium octyl sulfate, sodium oleate, sodium laurate, sodium stearate, and potassium stearate.

Such an inorganic dispersant as described above may be used in a commercially available state as it is, but in order to obtain fine particles thereof, such an inorganic dispersant may be produced in an aqueous medium prior to dispersion of the polymerizable monomer mixture in the aqueous system. For example, in the case of calcium phosphate, sodium phosphate aqueous solution and calcium aqueous chloride aqueous solution may be blended under high-speed stirring to form water-insoluble calcium phosphate allowing more uniform and finer dispersion. At this time, water-soluble sodium chloride is by-produced, but the presence of a water-soluble salt is effective for suppressing the dissolution of a polymerizable monomer in the aqueous medium, thus suppressing the production of ultrafine toner particles due to emulsion polymerization, and thus being more convenient. The presence of a water-soluble salt however can obstruct the removal of the residual polymerizable monomer in the final stage of polymerization, so that it is advisable to exchange the aqueous medium or effect desalting with ion-exchange resin. The inorganic dispersant can be removed substantially completely by dissolution with acid or alkali after the polymerization.

In the polymerization step, the polymerization temperature may be set to at least 40° C., generally in the range of 50–90° C. By polymerization in this temperature range, the release agent or wax to be enclosed inside the toner particles may be precipitated by phase separation to allow a more complete enclosure. In order to consume a remaining portion of the polymerizable monomer, the reaction temperature may possibly be raised up to 90–150° C. in the final stage of polymerization.

Polymerizate toner particles after the polymerization may be post-treated through conventional steps, such as filtration, washing and drying to provide toner particles, which may be powder-blended with inorganic fine powder to provide a toner in which the inorganic fine powder is attached onto toner particle surfaces. It is also a preferred mode to remove a coarse powder fraction and/or a fine powder fraction by incorporating a classification step in the polymerization toner production process.

It is also possible to blend the toner particles as described above with a charge control agent to provide an optimum level of triboelectric chargeability suitable for the developing system.

It is also a very preferred form of the magnetic toner of the present invention to contain inorganic fine powder having an average primary particle size of 4–80 nm as a flowability-improving agent in a proportion of 0.1–4 wt. % of the entire toner as a flowability-improving agent. Such an inorganic fine powder is added for the purpose of improving the toner flowability and uniformizing the chargeability of the toner particles. In this instance, it is also preferred to treat the inorganic fine powder for, e.g., hydrophobization, so as to adjust the chargeability and environmental stability of the toner.

In case where the inorganic fine powder has an average primary particle size larger than 80 nm, it becomes difficult to attain good toner flowability, so that the toner particles are liable to be charged non-uniformly, thus incurring difficulties, such as increased fog, a lower image density and lowering in continuous image forming performances, especially in a low humidity environment. On the other hand, in case where the inorganic fine powder has an average primary particle size of below 4 nm, the inorganic fine powder particles are liable to have too strong an agglomeratability and thus form agglomerated secondary particles providing a broad particle size distribution which cannot be readily disintegrated. As a result, the agglomerated toner particles are liable to damage the photosensitive member and the toner-carrying member, thus resulting in image defects. In order to provide a more uniform charge distribution of toner particles, the inorganic fine powder may further preferably have an average primary particle size of 6–35 nm.

The primary average particle size of inorganic fine powder may be determined on enlarged photographs of a toner (a mixture of toner particles and inorganic fine particles) taken through a scanning electron microscope equipped with an elementary analysis means, such as an XMA (X-ray microanalyzer), thereby selecting at least 100 primary particles of inorganic fine powder, while comparing the enlarged photographs with photographs mapped with characteristic elements of the inorganic fine powder, to measure a number-average particle size of the inorganic fine powder.

The content of the inorganic fine powder may be determined by fluorescent X-ray analysis based on a calibration curve prepared from standard samples.

The inorganic fine powder may comprise, e.g., silica, alumina or titania.

The inorganic fine powder having an average primary particle size of 4–80 nm may preferably be added in an amount of 0.1–4.0 wt. parts per 100 wt. parts of the toner particles. Below 0.1 wt. part, the effect is scarce, and above 4.0 wt. parts, the resultant toner is caused to have inferior fixability.

It is preferred that the inorganic fine powder has been hydrophobized so as to exhibit improved performances in a high humidity environment. If the inorganic fine powder added to the toner absorbs moisture, the toner chargeability is liable to be remarkably lowered, thus resulting in lower developing performances and transferability.

For the hydrophobization agent, it is possible to use treating agents, such as silicone varnish, various modified silicone varnish, silicone oil, various modified silicone oil, silane compounds, silane coupling agents, organo-silicon compounds and organo-titanium compounds, singly or in combination.

Among the above, silicone oil treatment is preferred, and more preferably, the inorganic fine powder is hydrophobized and then or simultaneously therewith treated with silicone oil, so as to retain a high-chargeability and reduce selective development even in a high humidity environment.

More specifically, the inorganic fine powder may be first subjected to silyltion for chemically dissipating the surface-active hydrogen group and then surface-coated with a hydrophobic film of silicone oil. The silylation agent may preferably be used in a proportion of 5–50 wt. parts per 100 wt. parts of the inorganic fine powder. An amount of below 5 wt. parts is insufficient for dissipating the active hydrogen group on the inorganic fine particle surfaces. On the other hand, at an amount in excess of 50 wt. parts, an excessive amount of the silylation agent functions as a glue for agglomerating the inorganic fine particles to result in image defects.

The silicone oil may preferably have a viscosity at 25° C. of 10–200,000 $mm^2/s$, more preferably 3,000–80,000 $mm^2/s$. Below 10 $mm^2/s$, the treated inorganic fine powder is liable to lack the stability and result in inferior images due to thermal and mechanical stresses. Above 200,000 $mm^2/s$, a uniform treatment is liable to be difficult.

The treatment with a silicone oil may be performed by mixing inorganic fine powder (already treated with or to be treated simultaneously with a silane compound) with the silicone oil directly in a blender, such as a Henschel mixer, or spraying the silicone oil onto the inorganic fine powder. Alternatively, it is also possible to apply a method wherein the silicone oil is dissolved or dispersed in an appropriate solvent, and the inorganic fine powder is mixed therewith, followed by removal of the solvent. The spraying method is preferred so as to provide relatively less agglomerates of the inorganic fine powder.

The silicone oil may preferably be applied in an amount of 1–23 wt. parts, more preferably 5–20 wt. pats, per 100 wt. parts of the inorganic fine powder. Too small an amount of silicone oil cannot provide a sufficient hydrophobicity, and too large an amount also causes the agglomeration of the inorganic fine powder.

The toner according to the present invention can further contain external additives other than the flowability improver, as desired.

For example, in order to improve the cleanability, it is possible to further add fine particles having a primary particle size exceeding 30 nm (and preferably also specific surface area of below 50 $m^2/g$), more preferably close-to-spherical inorganic or organic fine particles having a primary particle size of at least 50 nm (and preferably also a specific surface area of below 30 $m^2/g$), as a preferred mode. For example, it is preferred to use spherical silica particles, spherical polymethylsilsesquioxane particles or spherical resin particles.

Examples of other external additives may include: lubricant powder, such as polytetrafluoroethylene powder, zinc stearate powder, and polyvinylidene fluoride powder; abrasives, such as cerium oxide powder, silicon carbide powder and strontium titanate powder; anti-caking agents; and electroconductivity-imparting agents, such as carbon black powder, zinc oxide powder, and tin oxide powder. It is also possible to add a minor amount of opposite-polarity organic fine particles or inorganic fine particles as a developing improver. It is possible that these additives have been surface-hydrophobized.

Next, some embodiments of the image forming method and apparatus using a magnetic toner of the present invention will be described while referring to drawing.

Referring to FIG. 1, surrounding a photosensitive member 100 as an image-bearing member, a charging roller 117 (contact charging member), a developing device 140 (developing means), a transfer roller 114 (transfer means), a cleaner 116, and paper supply rollers 124, are disposed. The photosensitive member 100 is charged to e.g., −700 volts by the charging roller 117 supplied with an AC voltage of peak-to-peak 2.0 kV superposed with DC −700 volts and is exposed to imagewise laser light 123 from a laser beam scanner 121 to form an electrostatic latent image thereon, which is then developed with a mono-component magnetic toner by the developing device 140 to form a toner image. The toner image on the photosensitive member 100 is then transferred onto a transfer(-receiving) material P by means of the transfer roller 114 abutted against the photosensitive member 100 via the transfer material P. The transfer material P carrying the toner image is then conveyed by a conveyer belt 125, etc., to a fixing device 126, where the toner image is fixed onto the transfer material P. A portion of the toner remaining on the photosensitive member 100 is removed by the cleaner 116 (cleaning means).

Figure 2:
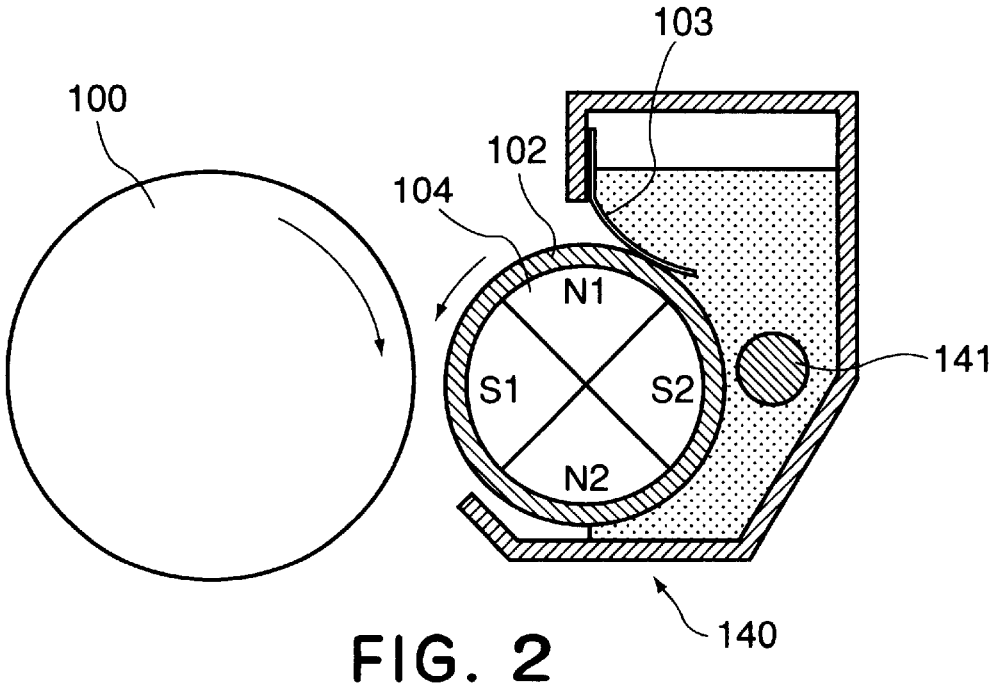
FIG. 2 is an enlarged view around a mono-component developing device included in the apparatus shown in FIG. 1.

As shown in more detail in FIG. 2, the developing device 140 includes a cylindrical toner-carrying member (hereinafter called a "developing sleeve") 102 formed of a non-magnetic metal, such a aluminum or stainless steel, and disposed in proximity to the photosensitive member 100, and a toner vessel containing the toner. The gap between the photosensitive member 100 and the developing sleeve 102 is set at ca. 300 $\mu$m by a sleeve/photosensitive member gap-retaining member (not shown), etc. The gap can be varied as desired. Within the developing sleeve 102, a magnet roller 104 is disposed fixedly and concentrically with the developing sleeve 102, while allowing the rotation of the developing sleeve 102. The magnet roller 104 is provided with a plurality of magnetic poles as shown, including a pole S1 associated with developing, a pole N1 associated with regulation of a toner coating amount, a pole S2 associated with toner take-in and conveyance, and a pole N2 associated with prevention of toner blowing-out. Within the toner reservoir, a toner-application member 141 is disposed to apply the toner onto the developing sleeve 102.

The developing device 140 is further equipped with an elastic blade 103 as a toner layer thickness-regulating member for regulating the amount of toner conveyed while being carried on the developing sleeve 102, by adjusting an abutting pressure at which the elastic blade 103 is abutted against the photosensitive member 100. In the developing region, a developing bias voltage comprising a DC voltage and/or an AC voltage is applied between the photosensitive member 100 and the developing sleeve 102, so that the toner on the developing sleeve 102 is caused to jump onto the photosensitive member 100 thereby forming a visible toner image corresponding to an electrostatic latent image formed thereon.

Figure 5:
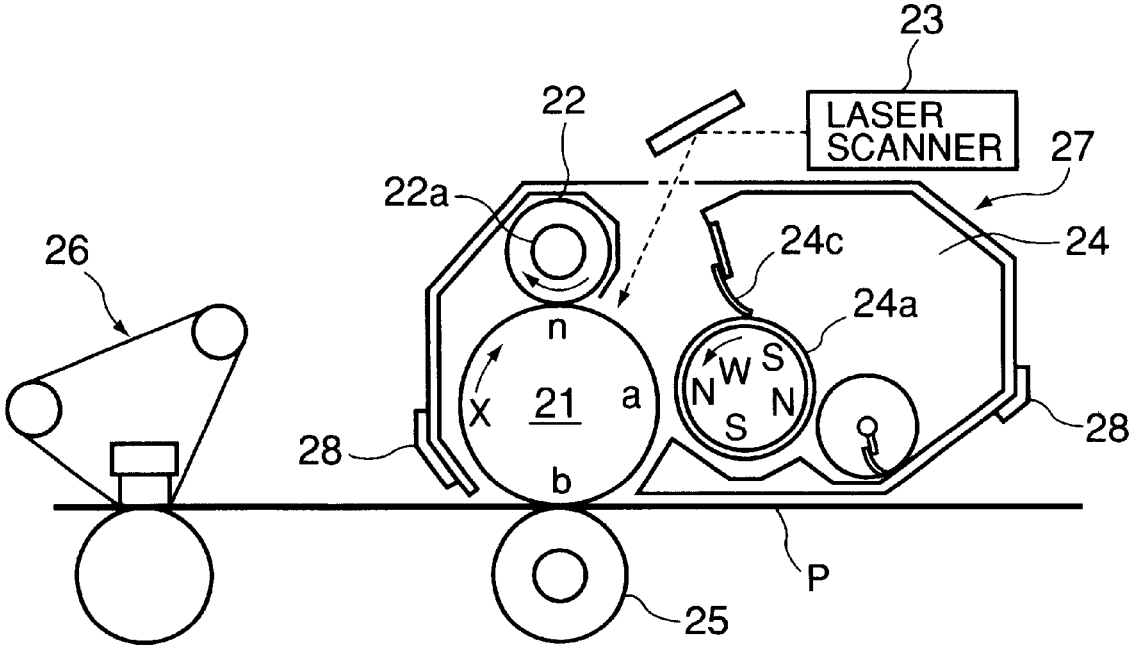
FIG. 5 is a schematic illustration of another image forming apparatus suitable for using a magnetic toner of the invention.

FIG. 5 illustrates another embodiment of the image forming apparatus suitable for using a magnetic toner of the present invention.

The image forming apparatus shown in FIG. 5 is a laser beam printer (recording apparatus) according to a transfer-type electrophotographic process and including a developing-cleaning system (cleanerless system). The apparatus includes a process-cartridge from which a cleaning unit having a cleaning member, such as a cleaning blade, has been removed. The apparatus uses a mono-component magnetic toner and a non-contact developing system wherein a toner-carrying member is disposed so that a toner layer carried thereon is in no contact with a photosensitive member for development.

Referring to FIG. 5, the image forming apparatus includes a rotating drum-type OPC photosensitive member 21 (as an image-bearing member), which is driven for rotation in an indicated arrow X direction (clockwise) at a prescribed peripheral speed (process speed).

A charging roller 22 (as a contact charging member) is abutted against the photosensitive member 21 at a prescribed pressing force in resistance to its elasticity. Between the photosensitive member 21 and the charging roller 22, a contact nip n is formed as a charging section. The charging roller 22 is rotated in an opposite direction (with respect to the surface movement direction of the photosensitive member 21) at the charging section n, thus providing a peripheral speed difference with the photosensitive member 21. Prior to the actual operation, electroconductive fine powder is applied on the charging roller 22 surface at a uniform density.

The charging roller 22 has a core metal 22*a* to which a DC voltage is applied from a charging bias voltage supply. As a result, the photosensitive member 1 surface is uniformly charged at a potential almost equal to the voltage applied to the charging roller 22.

The apparatus also includes a laser beam scanner 23 (exposure means) including a laser diode, a polygonal mirror, etc. The laser beam scanner outputs laser light with intensity modified corresponding to a time-serial electrical digital image signal, so as to scanningly expose the uniformly charged surface of the photosensitive member 21. By the scanning exposure, an electrostatic latent image corresponding to the objective image data is formed on the rotating photosensitive member 21.

The apparatus further includes a developing device 24, by which the electrostatic latent image on the photosensitive member 21 surface is developed to form a toner image thereon. The developing device 24 is a non-contact-type reversal development apparatus.

The developing device 24 further includes a non-magnetic developing sleeve 24*a* (as a developer-carrying member) and an elastic blade 24*c* as a toner layer thickness-regulating member abutted against the sleeve 24*a* so as to form a thin layer of charged magnetic toner on the sleeve 24*a*. According to the rotation of the sleeve 24*a*, the thus-formed layer of the magnetic toner is brought to a developing region a where the photosensitive member 21 and the sleeve 24*a* are opposite to each other. A developing bias voltage is applied to a developing bias voltage supply (not shown) thereby causing a developing bias voltage between the developing sleeve 24 and the photosensitive member 21 at the developing region a where the mono-component jumping development is effected under the action of the developing bias voltage.

A transfer roller 25 (as a contact transfer means) is abutted against the photosensitive member 21 at a prescribed linear pressure so as to form a transfer nip b. To the transfer nip b, a transfer material P as a recording medium is supplied from a paper supply section (not shown) at a prescribed timing, and prescribed transfer bias voltage is applied to the transfer roller 25 from a transfer bias voltage supply (not shown), whereby toner images on the photosensitive member 21 are successively transferred onto the surface of the transfer material P sent to the transfer nip b. The transfer roller is designed to have a medium level of prescribed resistivity to effect a toner transfer under application of a DC voltage. More specifically, while being passed through the transfer nip b, the transfer material P receives toner images formed on the photosensitive member 21 and transferred successively onto its face side under the action of an electrostatic fore and a pressing force.

A fixing device 26 of, e.g., the heat fixing type is also included. The transfer material P having received a toner image from the photosensitive member 21 at the transfer nip b is separated from the photosensitive member 21 surface and introduced into the fixing device 26, where the toner image is fixed to provide an image product (print or copy) to be discharged out of the apparatus.

In the image forming apparatus shown in FIG. 5, the cleaning unit has been removed, transfer-residual toner particles remaining on the photosensitive member 21 surface after the transfer of the toner image onto the transfer material P are not removed by such a cleaning means but, along with the rotation of the photosensitive member 21, sent via the charging section n to reach the developing section a, where they are subjected to a developing-cleaning operation to be recovered.

In the image forming apparatus of FIG. 5, three process units, i.e., the photosensitive member 21, the charging roller 22 and the developing device 24 are inclusively supported to form a process-cartridge 27, which is detachably mountable to a main assembly of the image forming apparatus via a guide and support member 28. A process-cartridge may be composed of other combinations of devices, e.g., a combination of a developing device and photosensitive member; and a combination of a developing device and a charging roller.

EXAMPLES

Hereinbelow, the present invention will be described more specifically with reference to Production Examples and Examples, which should not be however construed to restrict the scope of the present invention in any way. In the following Examples, "part(s)" used for describing relative amounts of ingredients are all by weight.

<Sulfur-Containing Resin>

Production Example 1

Into a reaction vessel equipped with a reflex pipe, a stirrer, a thermometer, a nitrogen intake pipe, a liquid-dropping device and a reduced pressure device, 250 parts of methanol, 150 parts of 2-butanone and 100 parts of 2-propanol (as solvents), and 84 parts of styrene (St), 13 parts of 2-ethylhexyl acrylate (2EHA) and 2 parts of 2-acrylamido-2-methylpropanesulfonic acid (AMPS) (as monomers), were charged and heated under stirring to a reflux temperature. Then, a solution of 4 parts of 2,2'-azobis(2-methylbutyronitrile) (as polymerization initiator) in 20 parts of 2-butanone was added dropwise in 30 min., followed by 5 hours of stirring, further addition of a solution of 0.4 part of 2,2'-azobis(2-methylbutyronitrile) in 20 parts of 2-butanone in 30 min. and further 5 hours of stirring, to complete the polymerization.

After distilling of the solvent under a reduced pressure, the resultant polymer was coarsely crushed by a cutter mill equipped with a 100 $\mu$m-screen to recover Sulfur-containing resin 1 of below 100 $\mu$m, Tg=ca. 69° C. and Mw (weight-average molecular weight)=20,000.

The monomer compositions, Tg and Mw of Sulfur-containing resin 1 are summarized in Table 1 below together with those of resins produced in the following Production Examples.

Production Examples 2–5

Sulfur-containing resins 2 to 5 were prepared in the same manner as in Production Example 1 except that the monomer compositions were changed as shown in Table 1 below and the polymerization conditions (the amount of the polymerization initiator, polymerization temperature and time) were adjusted so as to control the molecular weights.

Comparative Production Example

Comparative resin 1 was prepared in the same manner as in Production Example except for changing the monomer composition as shown in Table 1 below.

TABLE 1

| | Sulfur-containing resin | | | | | Comp. resin |
|---|---|---|---|---|---|---|
| Monomers | 1 | 2 | 3 | 4 | 5 | 1 |
| St | 84 | 74 | 91.47 | 86.8 | 3 | 87 |
| 2EHA | 13 | 17 | 8.5 | 13 | 17 | 13 |
| AMPS | 3 | 5 | 0.03 | 0.2 | 10 | 0 |
| Tg (° C.) | 69 | 61 | 80 | 70 | 59 | 70 |
| Mw | 20000 | 15000 | 55000 | 45000 | 10000 | 20000 |

<Hydrophobic Iron Oxide>

Production Example 1

Into a ferrous sulfate aqueous solution, an aqueous solution of caustic soda in an amount of 1.0–1.1 equivalent of the iron of the ferrous sulfate was added and mixed therewith to form an aqueous solution containing ferrous hydroxide.

While maintaining the pH of the aqueous solution at around 9, air was blown thereinto to cause oxidation at 80–90° C. to form a slurry containing magnetic iron oxide particles. After being washed and filtered, the wet magnetic iron oxide particles were once recovered and a portion thereof was subjected to measurement of a water content. Then, the remaining wet magnetic particles, without being dried, were re-dispersed in another aqueous medium, and the pH of the re-dispersion liquid of the magnetic particles was adjusted to ca. 6. Then, into the re-dispersion liquid under sufficient stirring, a silane coupling agent (n-$C_6H_{13}Si(OCH_3)_3$) in an amount of 2.0 parts per 100 parts of the magnetic iron oxide particles (calculated by subtracting the water content from the wet iron oxide particles) was added to effect a coupling treatment for hydrophobization. The thus-hydrophobized magnetic iron oxide particles were washed, filtered and dried in ordinary manners, followed further by disintegration of slightly agglomerated particles to obtain Hydrophobic iron oxide 1, of which the particle size distribution is shown in Table 2 appearing hereinafter together with those of magnetic iron oxide particles produced in the following Production Examples.

Production Example 2

Hydrophobic iron oxide 2 was prepared in the same manner as in Production Example 1 except that the silane coupling agent for treating the once recovered wet magnetic iron oxide particles was changed to 0.8 part of n-$C_4H_9Si(OCH_3)_3$ per 100 parts of the magnetic iron oxide particles.

Production Example 3

Hydrophobic iron oxide 3 was prepared in the same manner as in Production Example 2 except that the amount of the silane coupling agent (n-$C_4H_9Si(OCH_3)_3$) was reduced to 0.6 part per 100 parts of the magnetic iron oxide particles.

Production Example 4

Hydrophobic iron oxide 4 was prepared in the same manner as in Production Example 1 except that the silane coupling agent for treating the once-recovered wet magnetic iron oxide particles was changed to 2.5 parts of n-$C_{10}H_{21}Si(OCH_3)_3$ per 100 parts of the magnetic iron oxide particles.

Production Example 5

Hydrophobic iron oxide 5 was prepared in the same manner as in Production Example 4 except that the amount of the silane coupling agent (n-$C_{10}H_{21}Si(OCH_3)_3$) was increased to 3.0 parts per 100 parts of the magnetic iron oxide particles.

Production Example 6

Hydrophobic iron oxide 6 was prepared in the same manner as in Production Example 1 except for increasing the amount of the ferrous sulfate aqueous solution and reducing the amount of air blown into the solution.

Production Example 7

Hydrophobic iron oxide 7 was prepared in the same manner as in Production Example 4 except that the amount of the silane coupling agent (n-$C_{10}H_{21}Si(OCH_3)_3$ was increased to 5.0 parts per 100 parts of the magnetic iron oxide particles.

Production Example 8

The procedure of Production Example 1 was repeated up to the oxidation, and the resultant magnetic iron oxide particles were washed, filtrated and dried. After being disintegrated with respect to the agglomerates thereof, the dried magnetic iron oxide particles in 100 parts were blended with 5.0 parts of dimethylsilicone oil in a Henschel mixer (made by Mitsui Miike Kakoki K.K.) to obtain Hydrophobic iron oxide 8.

Production Example 9

The procedure of Production Example 1 was repeated up to the oxidation, and the resultant magnetic iron oxide particles were washed, filtrated and dried. The dried magnetic iron oxide particles were disintegrated with respect to agglomerates thereof to obtain Non-hydrophobic iron oxide

1.

TABLE 2

Particle size distribution of magnetic iron oxides

| Iron oxide | Particle size distribution: volume-average (μm) | % by number of ≧0.3 μm & <0.1 μm | % by number of ≧0.3 μm & >0.3 μm |
|---|---|---|---|
| Hydrophobic 1 | 0.18 | 15 | 4 |
| Hydrophobic 2 | 0.18 | 17 | 3 |
| Hydrophobic 3 | 0.18 | 22 | 2 |
| Hydrophobic 4 | 0.19 | 10 | 3 |
| Hydrophobic 5 | 0.21 | 8 | 7 |
| Hydrophobic 6 | 0.15 | 32 | 1 |
| Hydrophobic 7 | 0.22 | 5 | 10 |
| Hydrophobic 8 | 0.31 | 8 | 12 |
| Non- 1 hydrophobic | 0.18 | 19 | 3 |

<Provision of Electroconductive Fine Powders>

(Electroconductive Fine Powder 1)

Zinc oxide primary particles having a primary particle size of 0.1–0.3 μm were agglomerated under pressure to obtain Electroconductive fine powder 1, which was white in color, and exhibited a volume-average particle size (Dv) of 3.7 μm, a particle size distribution including 6.6% by volume of particles of below 0.5 μm (V % (<0.5 μm)=6.6% by volume) and 8% by number of particles of above 5 μm (N % (>5 μm)=8% by number), and a resistivity (Rs) of 80 ohm.cm.

As a result of observation through a scanning electron microscope (SEM) at magnifications of $3\times10^3$ and $3\times10^{14}$, Electroconductive fine powder 1 was found to include zinc oxide primary particles of 0.1–0.3 μm in primary particle size and agglomerated particles of 1–10 μm.

Electroconductive fine powder 1 also exhibited a transmittance of a mono-particle densest layer with respect to light of 740 nm in wavelength ($T_{740}$ (%)) of ca. 35% as measured by a transmission densitometer ("310T", available from X-Rite K.K.).

Some representative properties of Electroconductive powder 1 are shown in Table 3 appearing hereinafter together with those of Electroconductive fine powders 2–5 prepared in the following manner.

(Electroconductive Fine Powder 2)

Electroconductive fine powder 1 was pneumatically classified to obtain Electroconductive fine powder 2, which exhibited Dv=2.4 μm, V % (<0.5 μm)=4.1% by volume, N % (>5 μm)=1% by number, Rs=440 ohm.cm and $T_{740}$ (%)=35%.

As a result of the SEM observation, Electroconductive fine powder 2 was found to include zinc oxide primary particles of 0.1–0.3 μm in primary particle size and agglomerate particles of 1–5 μm, but the amount of the primary particles was reduced than in Electroconductive fine powder 1.

(Electroconductive Fine Powder 3)

Electroconductive fine powder 1 was pneumatically classified to obtain Electroconductive fine powder 3, which exhibited Dv=1.5 psi, V % (<0.5 μm)=35% by volume, N % (>5 μm)=0% by number, Rs=1500 ohm.cm and $T_{740}$ (%)=35%.

As a result of the SEM observation, Electroconductive fine powder 3 was found to include zinc oxide primary particles of 0.1–0.3 μm in primary particle size and agglomerate particles of 1–4 pin, but the amount of the primary particles was increased than in Electroconductive powder 1.

(Electroconductive Fine Powder 4)

White zinc oxide fine particles were used as Electroconductive fine powder 4, which exhibited Dv=0.3 μm, V % (<0.5 μm)=80% by volume, N % (>5 μm)=0% by number, primary particle sizes (Dp)=0.1–0.3 μm, Rs=100 ohm.cm and $T_{740}$ (%) 35%.

As a result of the TEM observation, Electroconductive fine powder 4 was found to comprise zinc oxide primary particles of Dp=0.1–0.3 μm and contain little agglomerate particles.

(Electroconductive Fine Powder 5)

Aluminum borate powder surface-coated with antimony tin oxide and having Dv=2.8 μm was pneumatically classified to remove coarse particles, and then subjected to a repetition of dispersion in aqueous medium and filtration to remove fine particles to recover electroconductive fine powder 5, which was grayish-white electroconductive fine powder and exhibited Dv=3.2 μm, V % (<0.5 μm)=0.4% by volume, and N % (>5 μm) 1% by number.

Representative properties of electroconductive fine powders 1–5 are inclusively shown in Table 3 below.

TABLE 3

Electroconductive fine posder Particle size distribution

| Name | Material* | Dv (μm) | V % (<0.5 μm) (% vol.) | N % (>0.5 μm) (% .Num.) | Rs (ohm. cm) | $T_{740}$ (%) |
|---|---|---|---|---|---|---|
| 1 | zinc oxide | 3.7 | 6.6 | 8 | 80 | 35 |
| 2 | " | 2.4 | 4.1 | 1 | 440 | 35 |
| 3 | " | 1.5 | 35 | 0 | 1500 | 35 |
| 4 | " | 0.3 | 80 | 0 | 100 | 35 |
| 5 | C.A.B. | 3.2 | 0.4 | 1 | 40 | — |

*" represents the same as above.
C.A.B. means coated aluminum borate.

<Magnetic Toner Particles)

Production Example 1

Into 710 parts of deionized water, 450 parts of 0.1 mol/1-$Na_3PO_4$ aqueous solution was added, and after warming up to 60° C., 1 N-hydrochloric acid was added thereto (in an amount sufficient to provide pH 5.5 after subsequent addition of calcium chloride so as to prevent the excessive broadening of specific gravity distribution of the resultant toner particles), followed by gradual addition of 67.7 parts of 1.0 mol/1-$CaCl_2$ aqueous solution, to form an aqueous medium containing calcium phosphate.

| | |
|---|---|
| Styrene | 80 parts |
| b-Butyl acrylate | 20 parts |
| Sulfur-containing resin 1 | 5 parts |
| Hydrophobic iron oxide 1 | 90 parts |

The above ingredients were sufficiently dispersed and mixed by an attritor (made by Mitsui Miike Kakoki K.K.) to form a monomeric mixture.

The monomeric mixture was then warmed up to 60° C., and 6 parts of an ester was comprising principally behenyl behenate (and having a DSC heat-absorption peak temperature (Tabs)=72° C.) was added thereto, followed further by dissolution of polymerization initiator comprising 4 parts of 2,2'-azobis(2,4-dimethyl valeronitrile) ($t_{1/2}$=140 mm., at 60° C.) and 2 parts of dimethyl-2,2'-azobisisobutyrate ($t_{1/2}$=270 mm. at 60° C.; $t_{1/2}$=80 mm. at 80° C.), to form a polymerizable composition.

The polymerizable composition was charged into the above-prepared aqueous medium and stirred at 60° C. in an $N_2$ atmosphere for 15 mm. at 10,000 rpm by a TK homomixer (made by Tokushu Kika Kogyo K.K.) to disperse the adroplets of the polymerizable composition. Then, the system was further stirred by a paddle stirrer and subjected to 7 hours of reaction at 60° C., followed by heating to 80° C. and further 3 hours of stirring at that temperature. After the reaction, the suspension liquid was cooled and hydrophobic acid was added thereto to dissolve the calcium phosphate. The polymerizate was then recovered by filtration, washed with water and dried under a reduced pressure of 0.3 kPa (2.3 torr) at 50° C. for 10 days to obtain Magnetic toner particles 1 having a weight-average particle size (D4) of 7.0 μm.

Production Example 2

Magnetic toner particles 2 were prepared in the same manner as in Production Example 1 except for using 4 parts of Sulfur-containing resin 2 instead of Sulfur-containing resin 1.

Production Example 3

Magnetic toner particles 3 were prepared in the same manner as in Production Example 1 except for reducing the amount of Sulfur-containing resin 1 to 3.5 parts.

Production Example 4

Magnetic toner particles 4 were prepared in the same manner as in Production Example 1 except for reducing the amount of Sulfur-containing resin 1 to 2 parts.

Production Example 5

Magnetic toner particles 5 were prepared in the same manner as in Production Example 1 except for using Hydrophobic iron oxide 2 instead of Hydrophobic iron oxide 1.

Production Example 6

Magnetic toner particles 6 were prepared in the same manner as in Production Example 1 except for using Hydrophobic iron oxide 3 instead of Hydrophobic iron oxide 1.

Production Example 7

Magnetic toner particles 7 were prepared in the same manner as in Production Example 1 except for using Hydrophobic iron oxide 4 instead of Hydrophobic iron oxide 1.

Production Example 8

Magnetic toner particles 8 were prepared in the same manner as in Production Example 1 except for using Hydrophobic iron oxide 5 instead of Hydrophobic iron oxide 1.

Production Example 9

Magnetic toner particles 9 were prepared in the same manner as in Production Example 1 except for using 9 parts of Sulfur-containing resin 3 instead of Sulfur-containing resin 1.

Production Example 10

Magnetic toner particles 10 were prepared in the same manner as in Production Example 1 except for using 5 parts of Sulfur-containing resin 4 instead of Sulfur-containing resin 1.

Production Example 11

Magnetic toner particles 11 were prepared in the same manner as in Production Example 1 except for using 5 parts of Sulfur-containing resin 3 instead of Sulfur-containing resin 1.

Production Example 12

Magnetic toner particles 12 were prepared in the same manner as in Production Example 1 except for using 2 parts of Sulfur-containing resin 5 instead of Sulfur-containing resin 1.

Production Example 13

Magnetic toner particles 13 were prepared in the same manner as in Production Example 1 except for increasing the amount of the calcium phosphate in the aqueous medium by adjusting the amounts of the $Na_3PO_4$ aqueous solution and the $CaCl_2$ aqueous solution.

Production Example 14

Magnetic toner particles 14 were prepared in the same manner as in Production Example 1 except for decreasing the amount of the calcium phosphate in the aqueous medium by adjusting the amounts of the $Na_3PO_4$ aqueous solution and the $CaCl_2$ aqueous solution.

Production Example 15

Magnetic toner particles 15 were prepared in the same manner as in Production Example 1 except for changing the stirring conditions for dispersing the droplets of the polymerizable composition to 10 mm. at 8000 rpm by the TK homomixer.

Production Example 16

Magnetic toner particles 15 were prepared in the same manner as in Production Example 1 except for changing the stirring conditions for dispersing the droplets of the polymerizable composition to 8 mm. at 7000 rpm by the TK homomixer.

Production Example 17

Magnetic toner particles 17 were prepared in the same manner as in Production Example 1 except for reducing the amount of Hydrophobic iron oxide 1 to 60 parts.

Production Example 18

Magnetic toner particles 18 were prepared in the same manner as in Production Example 1 except for increasing the amount of Hydrophobic iron oxide 1 to 120 parts.

Production Example 19

Magnetic toner particles 19 were prepared in the same manner as in Production Example 1 except for reducing the amount of the ester wax to 1 part.

Production Example 20

Magnetic toner particles 20 were prepared in the same manner as in Production Example 1 except for increasing the amount of the ester wax to 35 parts.

Production Example 21

Magnetic toner particles 21 were prepared in the same manner as in Production Example 1 except for using polyethylene wax (having a DSC heat-absorption peak temperature (Tabs)=110° C.) instead of the ester wax.

[Treated Wax 1]

Incidentally, Treated wax 1 used in some of the following Production Examples was prepared by admixing 3 parts of dicumyl peroxide with 22 parts of styrene monomer, and adding dropwise the resultant mixture into 75 parts of heat-melted paraffin wax having a melting point of 79° C., followed by 4 hours of reaction. Treated wax 1 thus obtained exhibited a softening point of 79.4° C.

Production Example 22

Into 292 parts of deionized water, 46 parts of 0.1 mol/1-$Na_3PO_4$ aqueous solution was added, and after warming up to 60° C., 1N-hydrochloric acid was added thereto (in an amount sufficient to provide pH 5.5 after subsequent addition of calcium chloride), followed by gradual addition of 67 parts of 1.0 mol/1-$CaCl_2$ aqueous solution, to form an aqueous medium containing calcium phosphate, to which 0.1 part of sodium dodecylbenzenesulfonate was further added.

| | |
|---|---|
| Styrene | 80 parts |
| b-Butyl acrylate | 20 parts |
| Sulfur-containing resin 1 | 5 parts |
| Hydrophobic iron oxide 1 | 90 parts |

The above ingredients were sufficiently disperse and mixed by an attritor (made by Mitsui Miike Kakoki K.K.) to form a monomeric mixture.

The monomeric mixture was then warmed up to 60° C., and 6 parts of Treated wax 1 prepared in the above-described manner was added thereto, followed further by dissolution of 5 parts of benzoyl peroxide (as polymerization initiator), to form a polymerizable composition.

The polymerizable composition was charged into the above-prepared aqueous medium and stirred at 60° C. in an $N_2$ atmospheric for 10 mm. at 15,000 rpm by a high speed stirrer ("CLEAMIX 0.8S", made by M-Technique K.K.) to disperse the adroplets of the polymerizable composition. Then, the system was heated to 80° C. in 30 mm. under further stirring by a paddle stirrer and subjected to 4 hours of reaction at 80° C., followed by addition of 4 parts of anhydrous sodium carbonate to the system.

Thereafter, the system was lowered to a reduced pressure of −50 kPa and subjected to 4 hours of distillation. After the distillation and cooling, the remaining alkaline suspension liquid was subjected to filtration, and the recovered polymerizate particles were washed three times with water to obtain wet magnetic toner particles.

Then, the wet magnetic toner particles was added to 1000 parts of dilute hydrochloric acid (pH 1.0) under stirring at room temperature, followed by further 3 hours of stirring and filtration. The recovered polymerizate was further washed 5 times with water and then dried for 5 days under vacuum at a pressure of 0.3 kPa (2.3 Torr), to obtain Magnetic toner particles 22 of D4=6.0 $\mu$m.

Comparative Production Example 1

Magnetic toner particles 23 were prepared in the same manner as in Production Example 1 except for using Hydrophobic iron oxide 7 instead of Hydrophobic iron oxide 1.

Comparative Production Example 2

| | |
|---|---|
| Styrene/n-butyl acrylate (= 80/20 by weight) copolymer (Mn = 24300, Mw/Mn = 3.0) | 100 parts |
| Sulfur-containing resin 1 | 5 parts |
| Non-hydrophobic iron oxide 1 | 90 parts |
| Ester wax used in Production Example 1 | 6 parts |

The above ingredients were blended in a blender and melt-kneaded through a twin-screw extruder heated at 90° C. After being cooled, the melt-kneaded product was coarsely crushed by a hammer mill and then finely pulverized by a jet mill, followed by pneumatic classification to obtain Magnetic toner particles 24 of D4=7.9 $\mu$m.

Comparative Production Example 3

Into a four-necked 500 ml-flask equipped with a stirring blade and a cooler, 3.0 parts of methyl vinyl ether-maleic anhydride copolymer (made by GAF Co., molecular weight=40,000) and 100 parts of methanol were placed and stirred for 2 hours at 60° C. to form a dispersion stabilizer solution containing the methyl vinyl ether-maleic anhydride copolymer under complete dissolution. After the system was cooled to room temperature, the following ingredients were added to the system.

| | |
|---|---|
| Styrene | 80 part(s) |
| Butyl acrylate | 20 part(s) |
| t-Dodecylmercaptan | 0.006 part(s) |
| Sulfur-containing resin 1 | 5 part(s) |

The mixture in the flask was moderately stirred (at 1000 rpm) while the atmosphere within the flask was aerated with nitrogen gas until the oxygen content in the system was lowered to 0.1% within ca. 1 hour. Then, the thermostat vessel temperature was raised to 60° C., and 0.2 part of 2,2'-azobisiso-butyronitrile (as polymerization initiator) was added thereto to effect 24 hour of polymerization. In 15 minutes after the heating, the liquid became turbid in white, and the liquid was white and turbid stable dispersion liquid even after the 24 hours of polymerization. A portion of the liquid was sampled and subjected to gas chromatography together with an internal standard, whereby a conversion rate of 95% was confirmed. The resultant dispersion liquid was subjected to centrifugation at 2000 rpm, thereby completely precipitating the polymerizate particles, from which a clear supernatant liquid was removed. Then, 200 parts of methanol was added and the mixture was stirred for 1 hour for washing. Then, the operation of centrifugation and washing with methanol was repeated. Then, the polymerizate was recovered by filtration and dried for 24 hour at 50° C. under vacuum. Then, white powdery resin particles were obtained at a yield of 90%.

Then, the resin particles were subjected to hybridization with 15 parts of Hydrophobic iron oxide 1 by means of a hybridizer (made by Nara Kikai Seisakusho K.K.). This hybridization operation was repeated 6 times. Then, 100 parts of the resultant colored resin particles were dispersed in 1000 parts of methanol, followed by 1 hour of stirring at 50° C. After cooling to room temperature, the dispersion liquid was filtrated to recover wet colored resin particles.

Then, 0.5 part of Sulfur-containing resin 1 dissolved in toluene was added to 100 wt. parts of the colored resin particles, and the mixture was stirred for 1 hour. After filtration, the particles were dried to obtain Magnetic toner particles 25.

Comparative Production Example 4

Magnetic toner particles 26 were prepared in the same manner as in Production Example 1 except for using Comparative resin 1 instead of Sulfur-containing resin 1.

Comparative Production Example 5

Magnetic toner particles 27 were prepared in the same manner as in Production Example 1 except for reducing the amount of Sulfur-containing resin 1 to 0.03 part.

Comparative Production Example 6

Magnetic toner particles 28 were prepared in the same manner as in Production Example 1 except for increasing the amount of Sulfur-containing resin 1 to 23 parts.

Comparative Production Example 7

Magnetic toner particles 29 were prepared in the same manner as in Production Example 1 except for increasing the amount of the ester wax to 45 parts.

Comparative Production Example 8

Magnetic toner particles 30 were prepared in the same manner as in Production Example 1 except for using paraffin wax (Tabs=35° C.) instead of the ester wax.

Comparative Production Example 9

Magnetic toner particles 31 were prepared in the same manner as in Production Example 1 except for using Hydrophobic iron oxide 8 instead of Hydrophobic iron oxide 1.

Comparative Production Example 10

| | |
|---|---|
| Styrene/n-butyl acrylate (= 80/20 by weight) copolymer (Mn = 31500, Mw/Mn = 2.8) | 100 parts |
| Sulfur-containing resin | 5 parts |
| Hydrophobic iron oxide 1 | 90 parts |
| Treated wax 1 | 6 parts |

The above ingredients were blended in a blender and melt-kneaded through a twin-screw extruder heated at 120° C. After being cooled, the melt-kneaded product was coarsely crushed by a hammer mill and then finely pulverized by a jet mill, followed by pneumatic classification to obtain Magnetic toner particles 32 of D4=7.3 pin.

Comparative Production Example 11

The coarsely crushed melt-kneaded product prepared in Comparative Production Example 10 was then finely pulverized not by the jet mill but by a turbo mill (made by Turbo Kogyo K.K.), and then subjected to a mechanical impact-applying surface treatment at 50° C. and a rotary treatment blade peripheral speed of 90 mm/sec., thereby obtaining spherical Magnetic toner particles of D4=8.2 $\mu$m.

<Magnetic Toners>

Example 1

100 parts of Magnetic toner particles 1 were blended with 1 part of hydrophobic silica fine powder ($S_{BET}$ (BET specific surface area)=140 $m^2/g$, obtained by treating silica powder having a primary particle size of 12 nm successively with hexamethyldisilazane and silicone oil) by means of a Henschel mixer (made by Mitsui Miike Kakoki (K.K.), to prepare Magnetic toner 1.

Examples 2–21

Magnetic toners 2–21 were prepared in the same manner as in Example 1 except for blending Magnetic toner particles 2–21, respectively, with the hydrophobic silica fine powder used in Example 1, while changing the amount of the hydrophobic silica fine powder to 1.5 parts (Example 13) and 0.6 part (Example 14) and 0.8 part (Example 17), respectively, per 100 parts of the associated magnetic toner particles, in some Examples noted in parentheses.

Example 22

Magnetic toner 22 was prepared by blending 100 parts of Magnetic toner particles 22 with 1.2 part of the hydrophobic silica powder used in Example 1.

Examples 23–27

Magnetic toners 23–27 were prepared by blending 100 parts by Magnetic toner particles 1 with 1 pat of the hydrophobic silica fine powder used in Example 1 and further with 2 parts each of Electroconductive fine powders 1–5, respectively.

Example 28

Magnetic toner 28 was prepared by blending 100 parts of Magnetic toner particles 22 with 1.2 parts of the hydrophobic silica fine powder used in Example 1 and 2 parts of Electroconductive fine powder 1.

Comparative Examples 1–9

Comparative Magnetic toners 1–9 were prepared by blending 100 parts each of Magnetic toner particles 23–31, respectively, with 1 part of the hydrophobic silica fine powder used in Example 1.

Comparative Examples 10 and 11

Comparative Magnetic toners 10 and 11 were prepared by blending 100 parts each of Magnetic toner particles 32 and 33, respectively, with 1.2 parts of the hydrophobic silica fine powder used in Example 1.

Comparative Examples 12 and 13

Comparative Magnetic toners 12 and 13 were prepared by blending 100 parts each of Magnetic toner particles 32 and 33, respectively, with 1.2 parts of the hydrophobic silica fine powder used in Example 1 and further with 2 parts of Electroconductive fine powder 1.

Various properties of Magnetic toners prepared in the above Examples and Comparative Examples are summarized in the following Table 4.

TABLE 4

Properties of Magnetic toners prepared in Examples and Comparative Examples

| Example | 1.000–1.025 | 0.975–1.000 | 0.950–0.975 | 0.925–0.950 | 0.900–0.925 | D4 (μm) | D4L/D4A | D4H/D4A | B/A | D/C ≦0.02 (%) | Cav. | E/A ($\times 10^{-4}$) | σ79.6 ($Am^2/kg$) | Cmode | D4/D1 | Volatile cont. (ppm) |
|---|---|---|---|---|---|---|---|---|---|---|---|---|---|---|---|---|
| 1 | 3 | 5 | 86 | 4 | 2 | 7.0 | 1.00 | 1.00 | 0 | 84 | 0.985 | 32 | 25.3 | 1.00 | 1.12 | 223 |
| 2 | 5 | 9 | 74 | 8 | 4 | 7.0 | 0.96 | 1.02 | 0 | 82 | 0.982 | 36 | 25.3 | 1.00 | 1.16 | 215 |
| 3 | 8 | 13 | 61 | 12 | 6 | 8.1 | 0.92 | 1.05 | 0 | 81 | 0.983 | 32 | 25.3 | 1.00 | 1.21 | 217 |
| 4 | 14 | 19 | 36 | 18 | 13 | 6.6 | 0.85 | 1.08 | 0.0001 | 78 | 0.980 | 35 | 25.3 | 1.00 | 1.25 | 210 |
| 5 | 4 | 7 | 77 | 8 | 3 | 8.1 | 0.98 | 1.03 | 0.0004 | 82 | 0.981 | 34 | 25.3 | 1.00 | 1.18 | 190 |
| 6 | 4 | 8 | 74 | 7 | 4 | 6.7 | 0.98 | 1.01 | 0.0008 | 84 | 0.979 | 33 | 25.3 | 1.00 | 1.17 | 180 |
| 7 | 5 | 8 | 74 | 7 | 5 | 6.8 | 0.96 | 1.02 | 0.0001 | 72 | 0.980 | 32 | 25.3 | 1.00 | 1.20 | 230 |
| 8 | 3 | 6 | 79 | 7 | 3 | 7.8 | 0.97 | 1.02 | 0 | 53 | 0.981 | 32 | 25.3 | 1.00 | 1.18 | 210 |
| 9 | 3 | 9 | 73 | 9 | 3 | 6.5 | 0.98 | 1.02 | 0 | 81 | 0.981 | 5 | 25.3 | 1.00 | 1.17 | 240 |
| 10 | 4 | 8 | 76 | 6 | 3 | 7.9 | 0.98 | 1.02 | 0 | 80 | 0.981 | 15 | 25.3 | 1.00 | 1.19 | 205 |
| 11 | 3 | 9 | 73 | 8 | 4 | 7.0 | 0.97 | 1.02 | 0 | 80 | 0.978 | 2 | 25.3 | 1.00 | 1.18 | 184 |
| 12 | 4 | 8 | 74 | 7 | 4 | 7.2 | 0.97 | 1.02 | 0 | 80 | 0.983 | 53 | 25.3 | 1.00 | 1.25 | 260 |
| 13 | 4 | 6 | 77 | 6 | 3 | 4.6 | 0.97 | 1.02 | 0 | 80 | 0.981 | 31 | 25.3 | 1.00 | 1.19 | 150 |
| 14 | 4 | 6 | 75 | 0 | 4 | 10.8 | 0.97 | 1.03 | 0 | 80 | 0.982 | 30 | 25.3 | 1.00 | 1.17 | 285 |
| 15 | 3 | 7 | 75 | 9 | 4 | 6.7 | 0.96 | 1.02 | 0 | 80 | 0.980 | 31 | 25.3 | 1.00 | 1.33 | 221 |
| 16 | 4 | 7 | 76 | 8 | 4 | 7.4 | 0.96 | 1.01 | 0 | 81 | 0.979 | 32 | 25.3 | 1.00 | 1.42 | 225 |
| 17 | 3 | 9 | 75 | 7 | 4 | 9.2 | 0.97 | 1.02 | 0 | 82 | 0.982 | 29 | 17.3 | 1.00 | 1.18 | 208 |
| 18 | 4 | 8 | 75 | 6 | 3 | 7.1 | 0.96 | 1.02 | 0.0012 | 88 | 0.972 | 48 | 37.2 | 1.00 | 1.18 | 243 |
| 19 | 4 | 7 | 76 | 7 | 4 | 7.5 | 0.97 | 1.02 | 0 | 80 | 0.980 | 31 | 26.1 | 1.00 | 1.17 | 196 |
| 20 | 6 | 17 | 72 | 18 | 13 | 7.1 | 0.96 | 1.02 | 0 | 80 | 0.968 | 31 | 22.9 | 1.00 | 1.18 | 254 |
| 21 | 4 | 8 | 76 | 7 | 3 | 6.7 | 0.98 | 1.02 | 0 | 79 | 0.977 | 30 | 25.3 | 1.00 | 1.19 | 198 |
| 22 | 3 | 4 | 87 | 4 | 2 | 6.0 | 1.00 | 1.00 | 0 | 83 | 0.987 | 30 | 25.3 | 1.00 | 1.12 | 85 |
| 23 | 3 | 5 | 86 | 4 | 2 | 7.0 | 1.00 | 1.00 | 0 | 84 | 0.987 | 32 | 25.3 | 1.00 | 1.12 | 220 |
| 24 | 3 | 5 | 86 | 4 | 2 | 7.0 | 1.00 | 1.00 | 0 | 84 | 0.986 | 32 | 25.3 | 1.00 | 1.12 | 218 |
| 25 | 3 | 5 | 86 | 4 | 2 | 7.0 | 1.00 | 1.00 | 0 | 84 | 0.986 | 32 | 25.3 | 1.00 | 1.12 | 219 |
| 26 | 3 | 4 | 87 | 4 | 2 | 7.0 | 1.00 | 1.00 | 0 | 84 | 0.985 | 32 | 25.3 | 1.00 | 1.12 | 219 |
| 27 | 3 | 5 | 86 | 4 | 2 | 6.0 | 1.00 | 1.00 | 0 | 83 | 0.988 | 29 | 25.3 | 1.00 | 1.12 | 221 |
| 28 | 3 | 4 | 87 | 4 | 3 | 6.0 | 1.00 | 1.00 | 0 | 83 | 0.987 | 30 | 25.3 | 1.00 | 1.12 | 85 |
| Comp. | | | | | | | | | | | | | | | | |
| 1 | 17 | 21 | 26 | 21 | 15 | 6.6 | 0.97 | 1.01 | 0 | 80 | 0.981 | 29 | 25.3 | 1.00 | 1.16 | 410 |
| 2 | 18 | 22 | 29 | 21 | 10 | 7.9 | 1.00 | 1.00 | 0.0014 | 80 | 0.953 | 13 | 253 | 0.95 | 1.16 | 274 |
| 3 | 0 | 0 | 100 | 0 | 0 | 7.6 | 1.00 | 1.00 | 0 | 86 | 0.985 | 32 | 25.3 | 1.00 | 1.05 | 262 |
| 4 | 5 | 10 | 50 | 10 | 25 | 7.8 | 0.75 | 1.03 | 0 | 72 | 0.978 | 0 | 25.3 | 1.00 | 1.36 | 227 |
| 5 | 13 | 21 | 25 | 21 | 20 | 12.5 | 0.78 | 1.15 | 0.0005 | 65 | 0.978 | 1 | 25.3 | 1.00 | 1.52 | 214 |
| 6 | 15 | 22 | 25 | 21 | 17 | 13.4 | 0.83 | 1.25 | 0 | 67 | 0.974 | 60 | 25.3 | 1.00 | 1.43 | 231 |
| 7 | 17 | 21 | 22 | 22 | 18 | 9.4 | 0.78 | 1.03 | 0.0012 | 76 | 0.962 | 31 | 25.3 | 1.00 | 1.33 | 241 |
| 8 | 5 | 10 | 45 | 22 | 18 | 8.6 | 0.78 | 1.03 | 0 | 72 | 0.973 | 32 | 25.3 | 1.00 | 1.38 | 430 |
| 9 | 18 | 21 | 22 | 21 | 18 | 5.8 | 0.77 | 1.14 | 0 | 88 | 0.982 | 10 | 25.3 | 1.00 | 1.31 | 460 |
| 10 | 0 | 0 | 99 | 1 | 0 | 7.3 | 1.00 | 1.00 | 0.0021 | 99 | 0.948 | 18 | 25.3 | 0.96 | 1.16 | 272 |
| 11 | 0 | 0 | 98 | 2 | 0 | 7.3 | 1.00 | 1.00 | 0.0024 | 97 | 0.958 | 17 | 25.3 | 0.96 | 1.16 | 258 |
| 12 | 0 | 0 | 98 | 2 | 0 | 7.3 | 1.00 | 1.00 | 0.0024 | 97 | 0.959 | 17 | 25.3 | 0.96 | 1.16 | 255 |
| 13 | 0 | 0 | 98 | 2 | 0 | 7.3 | 1.00 | 1.00 | 0.0024 | 97 | 0.959 | 17 | 25.3 | 0.96 | 1.16 | 250 |

<Photosensitive member A>

Figure 3:
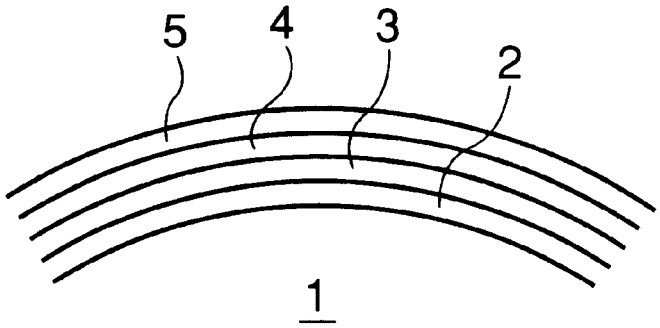
FIG. 3 illustrates an example of laminate structure of a photosensitive member suitable for use together with a magnetic toner of the invention.

Photosensitive member A having a laminar structure as shown in FIG. 3 was prepared by successively forming the following layers by dipping on a 30 mm-die. aluminum cylinder support 1.

(1) First layer 2 was a 15 μm-thick electroconductive coating layer (electroconductive) layer, principally comprising phenolic resin with powder of tin oxide and titanium oxide dispersed therein.

(2) Second layer 3 was a 0.6 μm-thick undercoating layer comprising principally modified nylon and copolymer nylon.

(3) Third layer 4 was a 0.6 μm-thick charge generation layer comprising principally an azo pigment having an absorption peak in a long-wavelength region dispersed within butyral resin.

(4) Fourth layer 5 was a 25 μm-thick charge transport layer comprising principally a hole-transporting triphenylamine compound dissolved in polycarbonate resin (having a molecular weight of $2\times10^4$ according to the Ostwald viscosity method) in a weight ratio of 8:10 and further containing 10 wt. % based on total solid of polytetrafluoroethylene powder (volume-average particle size (Dv)=0.2 μm) dispersed therein. The layer surface exhibited a contact angle with pure water of 95 deg. as measured by a contact angle meter ("CA-X", available from Kyowa Kaimen Kagaku K.K.).

Example A1

An image forming apparatus having an organization generally as illustrated in FIG. 1 and obtained by remodeling a commercially available laser beam printer ("LBP-1760", made by Canon K.K.) was used.

As a photosensitive member 100 (image-bearing member), Photosensitive member A (organic photoconductive (OPC) drum) prepared above was used. The photosensitive member 100 was uniformly charged to a dark part potential (Vd) of −700 volts by applying a charging bias voltage comprising a superposition of a DC voltage of −700 volts and an AC of 1.2 kVpp from a charging roller 117 coated with electroconductive carbon-dispersed nylon abutted at a linear pressure of 58.8 N/m (60 g/cm) against the photosensitive member 100. The charged photosensitive member was then exposed at an image part to imagewise laser light 123 from a laser scanner 121 so as to provide a light-part potential ($V_L$) of −180 volts.

A developing sleeve 102 (toner-carrying member) was disposed with a gap of 180 μm from the photosensitive member 100. The developing sleeve 102 was formed of a surface-blasted 16 mm-dia. aluminum cylinder coated with a ca. 7 μm-thick resin layer of the following composition exhibiting a roughness (JIS center line-average roughness Ra) of 1.0 μm. The developing sleeve 102 was equipped with a developing magnetic pole of 95 mT (950 Gauss) and a silicone rubber blade of 1.0 mm in thickness and 1.0 mm in free length as a toner layer thickness-regulating member.

| | |
|---|---|
| Phenolic resin | 100 parts |
| Graphite (Dv = ca. 7 μm) | 90 parts |
| Carbon black | 10 parts |

Then, a developing bias voltage of DC −500 volts superposed with an AC voltage of peak-to-peak 900 volts and frequency of 2100 Hz was applied, and the developing sleeve was rotated at a peripheral speed of 103 mm/sec which was 110% of the photosensitive member peripheral speed (94 mm/sec) moved in identical directions.

Figure 4:
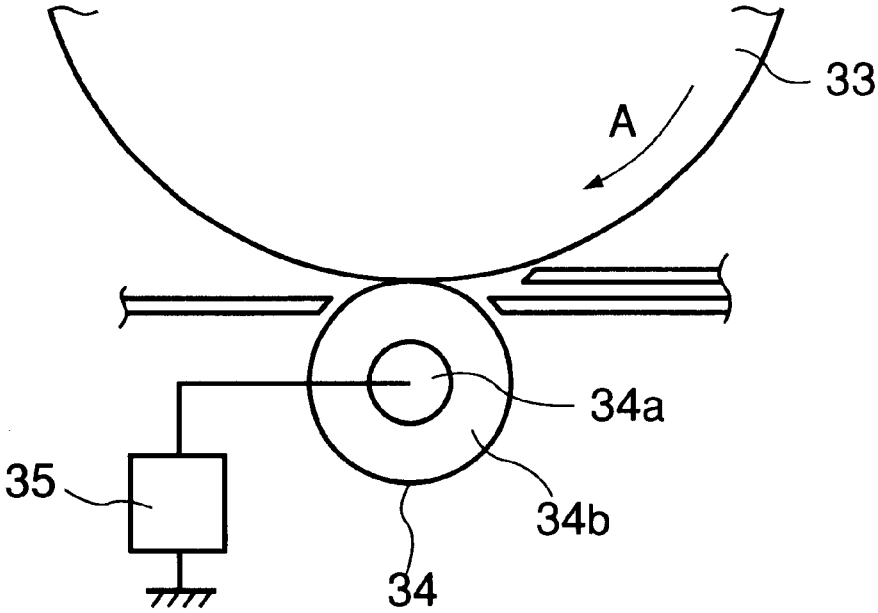
FIG. 4 is a schematic illustration of a contact transfer member.

A transfer roller 114 used was one identical to a roller 34 as shown in FIG. 4. More specifically, the transfer roller 34 had a core metal 34*a* and an electroconductive elastic layer 34*b* formed thereon comprising conductive carbon-dispersed ethylene-propylene rubber. The conductive elastic layer 34*b* exhibited a volume resistivity of $1\times10^8$ ohm.cm and a surface rubber hardness of 24 deg. The transfer roller 34 having a diameter of 20 mm was abutted against a photosensitive member 33 (photosensitive member 100 in FIG. 1) at a pressure of 59 N/m (60 g/cm) and rotated at a speed of 99 mm/sec which was 105% in an identical direction of that (94 mm/see) of the photosensitive member 33 rotating in an indicated arrow A direction while being supplied with a transfer bias voltage of DC 1.4 kV.

A fixing device 126 was an oil-less heat-pressing type device for heating via a film (of "LBP-1760", unlike a roller-type one as illustrated). The pressure roller was one having a surface layer of fluorine-containing resin and a diameter of 30 mm. The fixing device was operated at a fixing temperature of 170° C. and a nip width set to 7 mm.

In this particular example (Example A1), Magnetic toner 1 was used for a continuous image forming test for forming lateral line images having an image areal percentage of 4% on 8000 A4-size sheets of 75 g/m$^2$ in an environment of normal temperature/normal humidity (23° C./50%RH) for evaluation of image density, image fog and transferability.

Similar continuous image forming tests were also performed in an environment of high temperature/high humidity (30° C./80%RH) for evaluation of image density, transferability and solid image density uniformity, and low temperature/low humidity (15° C./10%RH) for evaluation of image density, image fog and thin-line reproducibility.

As a result of evaluation in general, the resultant images always exhibited high image density and little fog regardless of the environments. Further, the solid image density uniformity in the high temperature/high humidity environment was good, and the thin-line reproducibility in the low temperature/low humidity environment was excellent.

The image forming performance evaluation method and evaluation standards are described below, and the results of evaluation are inclusively shown in Table 5 together with those of Examples and Comparative Examples described hereinafter.

(1) Image Density (I.D.)

After the continuous image formation on 8000 sheets, a solid black image was printed on an ordinary plain paper (75 g/m$^2$) for copying, and the image density thereof was measured by a Macbeth reflection densitometer ("RD 918", made by Macbeth Co.) as a relative reflection density with reference to that (0.00) of the white background portion, and evaluation was made according to the following standard.

A: ≧1.40 (very good)

B: ≧1.35 and <1.40 (good)

C: ≧1.00 and <1.35 (practically of no problem)

D: <1.0 (somewhat problematic)

(2) Image Fog (Fog)

Fog density value (%) was determined as a difference between the whiteness (%) of a white background portion of a printed image and the whiteness (%) of a blank white paper, respectively, as measured by a reflection densitometer ("REFLECTMETER MODEL TC-6DS", made by Tokyo Denshoku K.K.) through a green filter. Evaluation was made based on the measured fog value according to the following standard:

A: <1.0% (very good)

B: ≧1.0% and <2.0% (good)

C: ≧2.0% and <3.0% (practically of no problem)

D: ≧3.0% (somewhat problematic)

(3) Transfer(ability)

Transfer residual toner on the photosensitive member at the time of solid black image formation was peeled off by applying and peeling a polyester adhesive tape, and the Macbeth image density of the peeled adhesive tape applied on white paper was measured as "C". An identical polyester adhesive tape was applied onto the yet unfixed solid black toner image on a white transfer paper, and the Macbeth image density thereof was measured as "D". Macbeth image density of a identical polyester adhesive tape applied on a blank white transfer paper was measured as "E". A transfer efficiency Teff was calculated according to the following formula:

$$Teff.(\%)=[(D-C)/(D-E)]\times 100.$$

Based on the measured Teff values, evaluation was made according to the following standard:

A: ≧97% (very good)

B: ≧94% and <97% (good)

C: ≧90% and <94% (practically acceptable)

D: <90% (not acceptable)

(4) Solid Image Density Uniformity (Solid ID)

A solid image formed on a transfer paper (of 75 g/m$^2$) after the continuous image formation on 8000 sheets was subjected to measurement of transmission image densities at the highest density portion and at the lowest image density portion among 9 divided rectangular portions taken in an area of 100 mm×100 mm on the transfer paper, respectively, by subtracting a transmission image density of the transfer paper, and based on the measured density difference between the highest and lowest density portions, evaluation was performed according to the following standard.

A: <0.03 (very good)

B: ≧0.03 and <0.06 (good)

C: ≧0.06 and <0.15 (practically of no problem)

D: ≧0.15 (somewhat problematic)

(5) Thin-Line Reproducibility (Thin Line)

A 100 μm-thin line latent image formed by laser exposure was developed with a toner, and the fixed toner image was subjected to measurement by an indicator of an average width of the reproduced line with respect to an enlarged image on a monitor by observation through a particle analyzer ("LUZEX 450"). The thin-line reproducibility is evaluated as follows based on % values calculated according to the following formula:

$$[(\text{measured line width})/(100\ \mu m)]\times 100.$$

A: <105% (very good)

B: ≧105% and <110% (good)

C: ≧110% and <120% (practically of no problem)

D: ≧120% (somewhat problematic)

Examples A2–A28

Image-forming tests and evaluation were performed in the same manner as in Example A1 except for using Magnetic toners 2 to 28. The toners exhibited generally good results through the continuous image forming on 8000 sheets. Magnetic toner 19 used in Example A19 resulted in slight soil on backside of transfer paper after continuous image formation on 5000 sheets in the low temperature/low humidity environment.

Comparative Examples A1–A13

Image forming tests and evaluation were performed in the same manner as in Example A1 except for using Comparative Magnetic toners 1 to 13, respectively, instead of Magnetic toner 1. As a general evaluation, the resultant images were generally inferior from the initial stage, and various image defects were observed on continuation of the image formation.

TABLE 5

| | | Image forming performances | | | | | | | | |
|---|---|---|---|---|---|---|---|---|---|---|
| | | 23° C./50% RH | | | 30° C./80% RH | | | 15° C./10% RH | | |
| Example | Magnetic toner | I.D. | Fog | Trans-fer | I.D. | Trans-fer | Solid ID | I.D. | Fog | Thin line |
| A1 | 1 | A | A | A | A | A | A | A | A | A |
| A2 | 2 | A | A | A | A | A | A | A | A | A |
| A3 | 3 | A | A | A | A | A | A | A | A | B |
| A4 | 4 | A | A | A | A | A | B | A | A | B |
| A5 | 5 | A | A | A | A | B | A | A | B | A |
| A6 | 6 | A | A | A | A | B | B | A | B | B |
| A7 | 7 | A | A | A | B | A | A | A | A | B |
| A8 | 8 | A | A | A | B | A | A | B | A | B |
| A9 | 9 | B | A | A | B | B | B | A | B | B |
| A10 | 10 | A | A | A | A | B | B | A | B | B |
| A11 | 11 | B | B | B | B | B | B | B | B | B |
| A12 | 12 | B | B | B | B | B | B | B | B | B |
| A13 | 13 | A | B | B | A | A | B | A | B | B |
| A14 | 14 | B | A | B | B | B | B | A | A | A |
| A15 | 15 | A | A | A | A | B | B | A | B | B |
| A16 | 16 | A | B | B | A | C | B | A | C | B |
| A17 | 17 | B | A | A | B | A | B | A | B | B |
| A18 | 18 | A | A | B | A | B | B | A | B | B |
| A19 | 19 | A | A | A | A | A | A | A | A | A |
| A20 | 20 | A | B | B | B | B | B | A | B | C |
| A21 | 21 | A | B | B | B | B | B | A | B | C |

TABLE 5-continued

| | | Image forming performances | | | | | | | | |
|---|---|---|---|---|---|---|---|---|---|---|
| | | 23° C./50% RH | | | 30° C./80% RH | | | 15° C./10% RH | | |
| Example | Magnetic toner | I.D. | Fog | Trans-fer | I.D. | Trans-fer | Solid ID | I.D. | Fog | Thin line |
| A22 | 22 | A | A | A | A | A | A | A | A | A |
| A23 | 23 | A | A | A | A | A | A | A | A | A |
| A24 | 24 | A | A | A | A | A | A | A | A | A |
| A25 | 25 | A | A | A | A | A | A | A | A | A |
| A26 | 26 | A | A | A | A | A | A | A | A | A |
| A27 | 27 | A | A | A | A | A | A | A | A | A |
| A28 | 26 | A | A | A | A | A | A | A | A | A |
| Comp. | Comp. | | | | | | | | | |
| A1 | 1 | A | B | B | B | C | C | A | C | D |
| A2 | 2 | A | B | C | B | D | D | A | D | D |
| A3 | 3 | A | B | B | A | C | D | A | C | D |
| A4 | 4 | A | B | B | B | C | C | A | C | D |
| A5 | 5 | C | B | C | D | D | D | B | C | D |
| A6 | 6 | C | D | A | B | A | D | D | D | D |
| A7 | 7 | A | C | C | B | D | C | A | B | D |
| A8 | 8 | B | C | B | C | C | B | A | D | D |
| A9 | 9 | C | C | C | D | D | B | B | D | C |
| A10 | 10 | A | B | B | A | C | C | A | D | C |
| A11 | 11 | A | B | B | A | B | C | A | D | C |
| A12 | 12 | A | B | B | A | C | C | A | C | C |
| A13 | 13 | A | B | B | A | B | C | A | C | C |

[Cleanerless Image Forming Performances]

Some magnetic toners prepared in the above-described Examples (Magnetic toners 23–28 and Comparative Magnetic toners 12–13) were subjected to image forming tests in an image forming system as shown in FIG. 5 (cleanerless image forming system using a developing-and-cleaning step).

<Photosensitive Member B>

Figure 6:
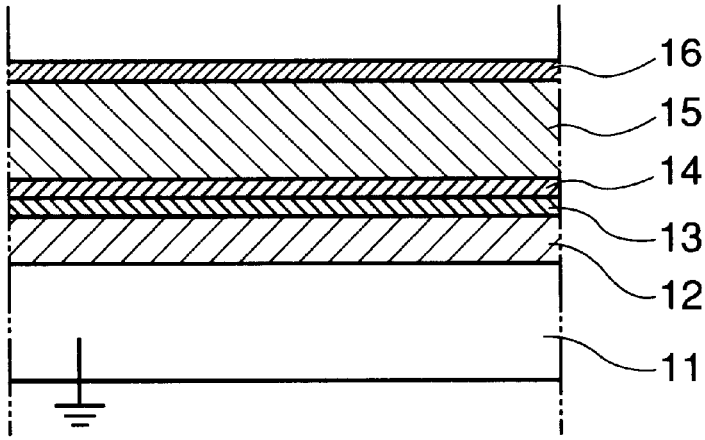
FIG. 6 illustrates another example of laminate structure of a photosensitive member suitable for use together with a magnetic toner of the invention.

Photosensitive member B was a negatively chargeable photosensitive member using an organic photoconductor ("OPC photosensitive member") having a sectional structure as shown in FIG. 6 and was prepared in the following manner.

A 30 mm-dia. aluminum cylinder was used as a substrate 11 on which the following first to fifth functional layers 12–16 were successively formed in this order respectively by dipping (except for the charge injection layer 16).

(1) First layer 12 was an electroconductive layer, a ca. 20 μm-thick conductor particle-dispersed resin layer (formed of phenolic resin with tin oxide and titanium oxide powder dispersed therein), for smoothening defects, etc., on the aluminum drum and for preventing the occurrence of moire due to reflection of exposure laser beam.

(2) Second layer 13 was a positive charge injection-preventing layer for preventing a positive charge injected from the A1 substrate 11 from dissipating the negative charge imparted by charging the photosensitive member surface and was formed as a ca. 1 μm-thick medium resistivity layer of Ca. $10^6$ ohm.cm formed of methoxymethylated nylon.

(3) Third layer 14 was a charge generation layer, a ca. 0.3 μm-thick resinous layer containing a disazo pigment dispersed in butyral resin, for generating positive and negative charge pairs on receiving exposure laser light.

(4) Fourth layer 14 was a Ca. 25 μm-thick charge transport layer formed by dispersing a hydrazone compound in a polycarbonate resin. This is a p-type semiconductor layer, so that the negative charge imparted to the surface of the photosensitive member cannot be moved through the layer but only the positive charge generated in the charge generation layer is transported to the photosensitive member surface.

(5) Fifth layer 16 was a charge injection layer containing electroconductive tin oxide ultrafine powder and Ca. 0.25 μm-dia. tetrafluoroethylene resin particles dispersed in a photocurable acrylic resin. More specifically, a liquid composition containing low-resistivity antimony-doped tin oxide particles of Ca. 0.03 μm in diameter in 100 wt. parts, tetrafluoroethylene resin particles in 20 wt. parts and a dispersing agent in 1.2 wt. parts, respectively per 100 wt. parts of the resin dispersed in the resin. was applied by spray coating, followed by drying and photocuring, to form a ca. 2.5 μm-thick charge injection layer 16.

The surfacemost layer of the thus-prepared photosensitive member exhibited a volume resistivity of $5\times10^{12}$ ohm.cm and a contact angle with water of 102 deg.

<Charging Member 1>

Charging member 1 (charging roller) was prepared in the following manner.

A SUS (stainless steel)-made roller of 6 mm in diameter and 264 mm in length was used as a core metal and coated with a medium resistivity roller-form foam urethane layer formed from a composition of urethane resin, carbon black (as electroconductive particles), a vulcanizing agent and a foaming agent, followed by cutting and polishing for shape and surface adjustment to obtain a charging roller having a flexible foam urethane coating layer of 12 mm in outer diameter and 234 mm in length. The thus-obtained Charging roller 1 exhibited a resistivity of $10^5$ ohm.cm and an Asker C hardness of 30 deg. with respect to the foam urethane layer. As a result of observation through a transmission electron microscope, the charging roller surface exhibited an average cell diameter of ca. 100 μm and a void percentage of 60%.

Example B1

An image forming apparatus having an organization as shown in FIG. 5 was used in this Example.

The image forming apparatus shown in FIG. 5 is a laser beam printer (recording apparatus) according to a transfer-type electrophotographic process and including a developing-cleaning system (cleanerless system). The apparatus includes a process-cartridge from which a cleaning unit having a cleaning member, such as a cleaning blade, has been removed. The apparatus uses a mono-component magnetic toner and a non-contact developing system wherein a toner-carrying member is disposed so that a toner layer carried thereon is in no contact with a photosensitive member for development.

(1) Overall Organization of an Image Forming Apparatus

Referring to FIG. 5, the image forming apparatus includes a rotating drum-type OPC photosensitive member 21 (Photosensitive member B prepared above) (as an image-bearing member), which is driven for rotation in an indicated arrow X direction (clockwise) at a peripheral speed (process speed) of 94 mm/sec.

A charging roller 22 (Charging member 1 prepared above) (as a contact charging member) is abutted against the photosensitive member 21 at a prescribed pressing force in resistance to its elasticity. Between the photosensitive member 21 and the charging roller 22, a contact nip n is formed as a charging section. In this example, the charging roller 22 is rotated to exhibit a peripheral speed ratio of 100% (corr. to a relative movement speed ratio of 200%) in an opposite direction (with respect to the surface movement direction of the photosensitive member 21) at the charging section n. Prior to the actual operation, Electroconductive fine powder 1 is applied on the charging roller 22 surface at a uniform density of ca. $1\times10^4$ particles/mm$^2$.

The charging roller 22 has a core metal 22*a* to which a DC voltage of −700 volts is applied from a charging bias voltage supply Si. As a result, the photosensitive member 1 surface is uniformly charged at a potential (−680 volts) almost equal to the voltage applied to the charging roller 22 in this Example. This is described later again.

The apparatus also includes a laser beam scanner 23 (exposure means) including a laser diode, a polygonal mirror, etc. The laser beam scanner outputs laser light (wavelength=740 nm) with intensity modified corresponding to a time-serial electrical digital image signal, so as to scanningly expose the uniformly charged surface of the photosensitive member 21. By the scanning exposure, an electrostatic latent image corresponding to the objective image data is formed on the rotating photosensitive member 21.

The apparatus further includes a developing device 24, by which the electrostatic latent image on the photosensitive member 21 surface is developed to form a toner image thereon. The developing device 24 is a non-contact-type reversal development apparatus and included, in this Example, a negatively chargeable mono-component insulating developer (Magnetic toner 23). As mentioned above, Magnetic toner 23 contained Electroconductive fine powder 1 externally added thereto.

The developing device 24 further included a non-magnetic developing sleeve 24*a* (as a developer-carrying member) of a surface-blasted 16 mm-dia. aluminum cylinder coated with a ca. 7 μm-thick resin layer of the following composition exhibiting a roughness (JIS center line-average roughness Ra) of 1.0 μm. The developing sleeve 24*a* was equipped with a developing magnetic pole 90 mT (900 Gauss) and a silicone rubber blade 24*c* of 1.0 mm in thickness and 1.5 mm in free length as a toner layer thickness-regulating member abutted at a linear pressure of 29.4 N/m (30 g/cm) against the sleeve 24*a*. The developing sleeve 24*a* was disposed with a gap of 300 μm from the photosensitive member 21.

| | |
|---|---|
| Phenolic resin | 100 parts |
| Graphite (Dv = ca. 7 μm) | 90 parts |
| Carbon black | 10 parts |

In the developing region a the developing sleeve 24*a* is rotated in an indicated arrow W direction to show a peripheral speed ratio of 120% of the surface moving speed of the photosensitive member 21 moving in an identical direction.

Magnetic toner is applied as a thin coating layer on the developing sleeve 24*a* by means of an elastic blade 24*c* while also be charged thereby. In the actual operation, Magnetic toner 23 was applied at a rate of 15 g/m$^2$ on the develop sleeve 24*a*.

Magnetic toner applied as a coating on the developing sleeve 24*a* is conveyed along with the rotation of the sleeve 24*a* to the developing section a where the photosensitive member 21 and the sleeve 24*a* are opposite to each other. The sleeve 24*a* is further supplied with a developing bias voltage from a developing bias voltage supply. In operation, the developing bias voltage was a superposition of DC voltage of −420 volts and a rectangular AC voltage of a frequency of 1600 Hz and a peak-to-peak voltage of 1500 volts (providing an electric field strength of $5.2\times10^6$ volts/m) to effect mono-component jumping development between the developing sleeve 24*a* and the photosensitive member 21.

The apparatus further includes a medium-resistivity transfer roller 25 (as a contact transfer means), which is abutted at a linear pressure of 98 N/in (100 g/cm) against the photosensitive member 21 to form a transfer nip b. To the transfer nip b, a transfer material P as a recording medium is supplied from a paper supply section (not shown), and a prescribed transfer bias voltage is applied to the transfer roller 25 from a voltage supply, whereby toner images on the photosensitive member 21 are successively transferred onto the surface of the transfer material P supplied to the transfer nip b.

In this Example, the transfer roller 25 had a resistivity of $5\times10^8$ ohm.cm and supplied with a DC voltage of +3000 volts to perform the transfer. Thus, the transfer material P introduced to the transfer nip b is nipped and conveyed through the transfer nip b, and on its surface, the toner images on the photosensitive member 21 surface are successively transferred under the action of an electrostatic force and a pressing force.

A fixing device 26 of, e.g., the heat fixing type is also included. The transfer material P having received a toner image from the photosensitive member 21 at the transfer nip b is separated from the photosensitive member 21 surface and introduced into the fixing device 26, where the toner image is fixed to provide an image product (print or copy) to be discharged out of the apparatus.

In the image forming apparatus used in this Example, the cleaning unit has been removed, transfer-residual toner particles remaining on the photosensitive member 21 surface after the transfer of the toner image onto the transfer material P are not removed by such a cleaning means but, along with the rotation of the photosensitive member 21, sent via the charging section n to reach the developing section a, where they are subjected to a developing-cleaning operation to be recovered.

In the image forming apparatus of this Example, three process units, i.e., the photosensitive member 21, the charging roller 22 and the developing device 24, are inclusively supported to form a process-cartridge 27, which is detachably mountable to a main assembly of the image forming apparatus via a guide and support member 28.

By using the above-described image forming apparatus, Magnetic toner 23 was subjected to a continuous image forming test on 3000 sheets (instead of 8000 sheets in Example A1) and the image forming performances thereof were evaluated with respect to similar items as in Example A1 in three environments of normal temperature/normal humidity (23° C./50%RH), high temperature/high humidity (30° C./80%RH) and low temperature/low humidity (15° C./10%RR).

The results are inclusively shown in Table 6 together with those of the following Examples.

Examples B2–B6

Image forming tests and evaluation were performed in the same manner as in Example B1 except for using Magnetic toners 24–28, respectively, instead of Magnetic toner 23 while applying Electroconductive fine powders 2–5 and 1, respectively, contained in these magnetic toners onto the charging roller 22 surface in advance of the operation.

In all the above-mentioned Examples B1 to B6, the resultant images were generally good from the outset to the end of the continuous image formation on 3000 sheets.

Comparative Examples B1 and B2

Image forming tests and evaluation were performed in the same manner as in Example B1 except for using Comparative Magnetic toners 12 and 13, respectively, instead of Magnetic toner 23. As a result, the images formed in the initial stage were satisfactory in each Comparative Example. On continuation of the image formation, however, the solid image density uniformity became inferior from about 1500 sheets for Comparative Magnetic toner 12 and from about 2000 sheets for Comparative Magnetic toner 13, respectively, in the high temperature/high humidity environment. On the other hand, in the low temperature/low humidity environment, the thin-line reproducibility became inferior from about 2000 sheets for Comparative Magnetic toner 12 and from about 2500 sheets for Comparative Magnetic toner 13.

What is claimed is:

1. A magnetic toner, having a dry specific gravity of (A) and comprising toner particles each comprising at least a binder resin and iron oxide dispersed therein, wherein the magnetic toner has a specific gravity distribution of toner particle fractions obtainable through wet sedimentation and including:

at most 15 wt. % of a fraction having a specific gravity of above (A)×1.000 and at most (A)×1.025, 0.1–20 wt. % of a fraction having a specific gravity of above (A)×0.975 and at most (A)×1.000, at least 30 wt. % of a fraction having a specific gravity of above (A)×0.950 and at most (A)×0.975, 0.1–20 wt. % of a fraction having a specific gravity of above (A)×0.925 and at most (A)×0.950, and at most 15 wt. % of a fraction having a specific gravity of above (A)×0.900 and at most (A)×0.925.

2. The magnetic toner according to claim 1, further satisfying relationships shown below:

$$(D4L)/(D4A) \geqq 0.8 \text{ and } (D4H)/(D4A) \leqq 1.1,$$

wherein (D4L) represents a weight-average particle size of a toner particle fraction having a specific gravity of at most (A)×0.950, (D4H) represents a weight-average particle size of a toner particle fraction having a specific gravity larger than (A)×0.975, and (D4A) represents a weight-average particle size of the entire toner particles.

3. The magnetic toner according to claim 1, wherein the magnetic toner has a toluene-equivalent organic volatile matter content of 10–400 ppm by weight of the toner as measured by a toner heating temperature of 150° C. by organic volatile matter analysis according to the head space method.

4. A magnetic toner according to claim 1, wherein the magnetic toner has an average circularity of at least 0.970.

5. A magnetic toner according to claim 1, wherein the magnetic toner comprises toner particles satisfying:

(i) a B/A ratio of below 0.001 between a surface-exposed content B of iron and a surface-exposed content A of carbon, respectively as measured by X-ray photoelectron microscopy, and (ii) at least 50% by number of toner particles satisfying a relationship of D/C≦0.02, wherein C represents a projection area-based circle-equivalent diameter of a toner particle, and D represents a minimum distance between a surface of the toner particle and individual

TABLE 6

| | | in cleanerless image forming system | | | | | | | | |
|---|---|---|---|---|---|---|---|---|---|---|
| | | 23° C./50% RH | | | 30° C./80% RH | | | 15° C./10% RH | | |
| Example | Magnetic toner | I.D. | Fog | Trans-fer | I.D. | Trans-fer | Solid ID | I.D. | Fog | Thin line |
| B1 | 23 | A | A | A | A | A | A | A | A | A |
| B2 | 24 | A | A | A | A | A | A | A | A | A |
| B3 | 25 | A | A | A | A | A | A | A | A | A |
| B4 | 26 | A | A | A | A | A | A | A | A | A |
| B5 | 27 | A | A | A | A | A | A | A | A | A |
| B6 | 28 | A | A | A | A | A | A | A | A | A |
| Comp. | Comp. | | | | | | | | | |
| B1 | 12 | A | B | B | A | C | C | A | C | C |
| B2 | 13 | A | B | B | A | B | C | A | C | C |

iron oxide particles on a sectional picture of the toner particle taken through a transmission electron microscope.

6. A magnetic toner according to claim 1, wherein the toner particles satisfying an E/A ratio in a range of 0.0033–0.0050 between a surface exposed content E of sulfur and a surface-exposed content A of carbon, respectively as measured by X-ray photoelectron microscopy.

7. A magnetic toner according to claim 1, wherein the iron oxide has an average particle size of 0.1–0.3 μm, and contains at most 40% by number of particles having a particle size of 0.03–0.1 μm.

8. A magnetic toner according to claim 1, wherein the iron oxide contains 1–30% by number of particles having a particle size of 0.03–0.1 μm and contains at most 10% by number of particles having a particle size of at least 0.3 μm.

9. A magnetic toner according to claim 1, wherein the iron oxide contains at most 5% by number of particles having a particle size of at least 0.3 μm.

10. A magnetic toner according to claim 1, wherein the magnetic toner has a magnetization of 10–50 $Am^2/kg$ (emu/g) at a magnetic field of 79.6 kA/m (=1000 oersted).

11. A magnetic toner according to claim 5, wherein the toner particles satisfy a ratio B/A of below 0.005.

12. A magnetic toner according to claim 5, wherein the toner particles satisfy a ratio B/A of below 0.003.

13. A magnetic toner according to claim 5, wherein the toner particles contain at least 65% by number of toner particles satisfying the relationship of $D/C \leqq 0.02$.

14. A magnetic toner according to claim 5, wherein the toner particles contain at least 75% by number of toner particles satisfying the relationship of $D/C \leqq 0.02$.

15. A magnetic toner according to claim 1, wherein the toner particles include:

at most 10 wt. % of a fraction having a specific gravity of above (A)×1.000 and at most (A)×1.025, 0.5–15 wt. % of a fraction having a specific gravity of above (A)×0.975 and at most (A)×1.000, at least 40 wt. % of a fraction having a specific gravity of above (A)×0.950 and at most (A)×0.975, 0.5–15 wt. % of a fraction having a specific gravity of above (A)×0.925 and at most (A)×0.950, and at most 10 wt. % of a fraction having a specific gravity of above (A)×0.900 and at most (A)×0.925.

16. A magnetic toner according to claim 1, wherein the toner particles include:

1–5 wt. % of a fraction having a specific gravity of above (A)×1.000 and at most (A)×1.025, 3–10 wt. % of a fraction having a specific gravity of above (A)×0.975 and at most (A)×1.000, 40–90 wt. % of a fraction having a specific gravity of above (A)×0.950 and at most (A)×0.975, 3–10 wt. % of a fraction having a specific gravity of above (A)×0.925 and at most (A)×0.950, and 1–5 wt. % of a fraction having a specific gravity of above (A)×0.900 and at most (A)×0.925.

17. A magnetic toner according to claim 1, wherein the toner particles contain a sulfur-containing resin.

18. A magnetic toner according to claim 17, wherein the sulfur-containing resin comprises a sulfonic acid group-containing polymer.

19. A magnetic toner according to claim 17, wherein the sulfur-containing resin includes polymerized units of a sulfonic acid group-containing (meth)acrylamide having a sulfonic acid group represented by $—SO_3X$ wherein X is H or an alkaline metal.

20. A magnetic toner according to claim 19, wherein the sulfur-containing resin contains 0.01–20 wt. % of the polymerized units of the sulfonic acid group-containing (meth) acrylamide.

21. A magnetic toner according to claim 17, wherein the sulfur-containing resin has a glass-transition temperature (Tg) of 50–100° C.

22. A magnetic toner according to claim 17, wherein the sulfur-containing resin has a weight-average molecular weight of 2,000–100,000.

23. A magnetic toner according to claim 1, wherein the toner particles contain 0.05–20 wt. parts of the sulfur-containing resin per 100 wt. parts of another binder resin.

24. A magnetic toner according to claim 1, wherein the toner particles contain 0.5–40 wt. % of a wax based on the binder resin.

25. A magnetic toner according to claim 24, wherein the wax shows a maximum heat absorption peak at a temperature in a range of 40–110° C. on a DSC curve on heating measured by a differential scanning calorimeter.

26. A magnetic toner according to claim 24, wherein the wax shows a maximum heat absorption peak at a temperature in a range of 45–90° C. on a DSC curve on heating measured by a differential scanning calorimeter.

27. A magnetic toner according to claim 1, wherein the iron oxide has been surface-treated with a coupling agent in an aqueous medium.

28. A magnetic toner according to claim 1, wherein the magnetic toner has a mode circularity of at least 0.99.

* * * * *

UNITED STATES PATENT AND TRADEMARK OFFICE

CERTIFICATE OF CORRECTION

PATENT NO. : 6,653,035 B2 
DATED : November 25, 2003
INVENTOR(S) : Keji Komoto et al.

It is certified that error appears in the above-identified patent and that said Letters Patent is hereby corrected as shown below:

Column 21,
Line 31, "phosphates," should read -- phosphites, --.

Column 31,
Line 37, "St 84 74 91.47 86.8 3 87" should read -- St 84 78 91.47 86.8 73 87 --

Column 33,
Line 18, "Non-l hydrophobic" should read-- Non-hydrophobic 1 --; and
Line 65, 1-4 pin," should read -- 1-4 $\mu$m --.

Column 34,
Line 24, "posder" should read -- powder --;
Line 64, "140 mm.," should read -- 140 min., --; and
Line 66, "mm." should read -- min. -- and "80 mm." should read -- 80 min. --.

Column 35,
Line 3, "15 mm." should read -- 15 min. --.

Column 36,
Line 33, "10 mm." should read -- 10 min. --; and
Line 40, "8 mm." should read -- 8 min. --.

Column 37,
Line 41, "10 mm." should read -- 10 min. --.

Column 38,
Line 33, "Butly acrylate 20 part(s)" should read -- Butyl acrylate 40 part(s) --.

Column 39,
Line 56, "D4 = 7.3 pin." should read -- D4 = 7.3 $\mu$m --.

Column 41,
Table 4, Example 13-15, "6 should read -- 6
0 9
9" 9 --;

UNITED STATES PATENT AND TRADEMARK OFFICE

CERTIFICATE OF CORRECTION

PATENT NO. : 6,653,035 B2
DATED : November 25, 2003
INVENTOR(S) : Keji Komoto et al.

It is certified that error appears in the above-identified patent and that said Letters Patent is hereby corrected as shown below:

Column 41 (cont'd),
Table 4, Example 22-25, "0.987 should read -- 0.987
0.987 0.986
0.986 0.987
0.986" 0.986 -- and
"85 should read -- 85
220 216
218 220
219 218
219 219 --; and
Table 4, Comp. Ex. 1-3, "0 should read -- 0
0.0014 0.0015
0" 0 --; and
"25.3 should read -- 25.3
253 25.3
25.3" 25.3 --;
Table 4, Comp. Ex. 9-11, "1.00 should read -- 1.00
0.96 0.95
0.96" 0.96 --; and
Table 4, "Comp." should read -- Comp. Example --.

Column 47,
Table 5, "A4 4 A B B B C C A C D" should read
-- A4 4 B B B B C C B D D --;
Line 56, "Ca. $10^6$" should read -- ca. $10^6$ --; and
Line 63, "Ca. 25" should read -- ca. 25 --.

Column 48,
Line 33, "Ca 0.25" should read -- ca. 0.25 --;
Line 37, "Ca. 0.03" should read -- ca. 0.03 --; and
Line 40, "resin. was" should read -- resin, was --.

Column 49,
Line 34, "Si." should read -- S1. --.

Column 50,
Line 33, "98 N/in" should read -- 98 N/m --.

UNITED STATES PATENT AND TRADEMARK OFFICE

CERTIFICATE OF CORRECTION

PATENT NO. : 6,653,035 B2
DATED : November 25, 2003
INVENTOR(S) : Keji Komoto et al.

It is certified that error appears in the above-identified patent and that said Letters Patent is hereby corrected as shown below:

Column 51,
Line 13, "C. 10% RR)." should read -- C./10% RH). --.

Signed and Sealed this

Thirty-first Day of August, 2004

JON W. DUDAS
*Director of the United States Patent and Trademark Office*